US010266791B2

(12) United States Patent
Tang et al.

(10) Patent No.: US 10,266,791 B2
(45) Date of Patent: Apr. 23, 2019

(54) DETERGENT COMPOSITIONS

(71) Applicant: The Procter & Gamble Company, Cincinnati, OH (US)

(72) Inventors: Ming Tang, Beijing (CN); Qing Chen, Beijing (CN); Wenting Liu, Beijing (CN); Shuo Li, Mason, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 15/345,531

(22) Filed: Nov. 8, 2016

(65) Prior Publication Data

US 2017/0137746 A1 May 18, 2017

(30) Foreign Application Priority Data

Nov. 13, 2015 (WO) ..... PCT/CN2015/094511

(51) Int. Cl.

| | |
|---|---|
| ***C11D 1/10*** | (2006.01) |
| ***C11D 1/14*** | (2006.01) |
| ***C11D 1/29*** | (2006.01) |
| ***C11D 1/66*** | (2006.01) |
| ***C11D 3/10*** | (2006.01) |
| ***C11D 11/00*** | (2006.01) |
| ***C11D 17/06*** | (2006.01) |
| ***C11D 10/04*** | (2006.01) |
| ***C11D 3/00*** | (2006.01) |
| *C11D 1/22* | (2006.01) |
| *C11D 1/72* | (2006.01) |

(52) U.S. Cl.

CPC ..... *C11D 1/146* (2013.01); *C11D 1/29* (2013.01); *C11D 1/66* (2013.01); *C11D 3/0094* (2013.01); *C11D 3/10* (2013.01); *C11D 10/04* (2013.01); *C11D 11/0017* (2013.01); *C11D 11/0023* (2013.01); *C11D 17/06* (2013.01); *C11D 1/22* (2013.01); *C11D 1/72* (2013.01)

(58) Field of Classification Search

None

See application file for complete search history.

(56) References Cited

U.S. PATENT DOCUMENTS

| | | | |
|---|---|---|---|
| 3,563,901 | A | 2/1971 | Crotty |
| 5,646,107 | A | 7/1997 | Emery et al. |
| 6,294,513 | B1 | 9/2001 | Jensen et al. |
| 6,677,289 | B1 | 1/2004 | Price et al. |
| 7,608,653 | B2 | 10/2009 | Wulff et al. |
| 7,923,426 | B2 | 4/2011 | Price et al. |
| 9,080,129 | B2 | 7/2015 | Benlahmar et al. |

(Continued)

FOREIGN PATENT DOCUMENTS

| | | |
|---|---|---|
| CA | 2219669 A | 5/1998 |
| EP | 0439316 A2 | 7/1991 |

(Continued)

OTHER PUBLICATIONS

International Search Report; International Application No. PCT/CN2015/094510; 5 pages.

(Continued)

*Primary Examiner* — Necholus Ogden, Jr.

(74) *Attorney, Agent, or Firm* — John T. Dipre

(57) ABSTRACT

Detergent compositions with improved sudsing profile, which are particularly suitable for hand-washing fabrics and dishware.

3 Claims, 1 Drawing Sheet

(56) References Cited

U.S. PATENT DOCUMENTS

| | | | | |
|---|---|---|---|---|
| 2005/0026803 | A1 | 2/2005 | Sivik et al. | |
| 2005/0124738 | A1 | 6/2005 | Sivik et al. | |
| 2008/0146482 | A1 | 6/2008 | Schneiderman et al. | |
| 2009/0270304 | A1 | 10/2009 | Cermenati et al. | |
| 2009/0305939 | A1* | 12/2009 | Tang | C11D 1/143 510/359 |
| 2010/0323946 | A1 | 12/2010 | Connors et al. | |
| 2014/0366281 | A1 | 12/2014 | Mort, III et al. | |
| 2015/0191676 | A1 | 7/2015 | Liu et al. | |
| 2015/0275135 | A1* | 10/2015 | Si | C08F 220/56 510/341 |
| 2015/0337236 | A1 | 11/2015 | Tang et al. | |
| 2017/0137745 | A1 | 5/2017 | Tang et al. | |
| 2017/0137747 | A1 | 5/2017 | Tang et al. | |
| 2017/0137748 | A1 | 5/2017 | Tang et al. | |

FOREIGN PATENT DOCUMENTS

| | | | |
|---|---|---|---|
| EP | 0829530 | A1 | 3/1998 |
| EP | 874041 | A | 10/1998 |
| EP | 2119764 | A | 11/2009 |
| EP | 2581438 | A | 4/2013 |
| GB | 2278124 | A | 11/1994 |
| WO | 9500117 | A | 1/1995 |
| WO | 9631589 | A | 10/1996 |
| WO | 9738956 | A | 10/1997 |
| WO | 9739087 | A | 10/1997 |
| WO | 9739088 | A | 10/1997 |
| WO | 9739090 | A | 10/1997 |
| WO | 9919434 | A1 | 4/1999 |
| WO | 9919453 | A | 4/1999 |
| WO | 200105923 | A | 1/2001 |
| WO | 200105924 | A | 1/2001 |
| WO | 2006113313 | A | 10/2006 |
| WO | WO 2014/018309 | A1 | 1/2014 |
| WO | 9739091 | A | 10/2016 |

OTHER PUBLICATIONS

International Search Report; International Application No. PCT/CN2015/094511; 5 pages.
International Search Report; International Application No. PCT/CN2015/094512; 4 pages.
International Search Report; International Application No. PCT/CN2015/094513; 4 pages.
U.S. Appl. No. 15/345,529, filed Nov. 8, 2016, Tang, et al.
U.S. Appl. No. 15/345,535, filed Nov. 8, 2016, Tang, et al.
U.S. Appl. No. 15/345,541, filed Nov. 8, 2016, Tang, et al.

* cited by examiner

DETERGENT COMPOSITIONS

FIELD OF THE INVENTION

The present invention relates generally to detergent compositions, particularly to laundry or dish detergent compositions, and more particularly to detergent compositions specifically designed for manual/hand washing or semi-automatic washing of fabric or dishware.

BACKGROUND OF THE INVENTION

Detergents comprising anionic detersive surfactants for cleaning fabrics have been known for many years. Historically, cleaning laundry was defined primarily as a process that involved removal of stains. Consistent with this historical approach to cleaning, laundry detergent designers focused on formulating detergents with surfactants with longer carbon chains to ensure maximum surface activity of the surfactants to achieve the most effective soil removal.

Such long-chain surfactants can generate copious suds during wash cycles of the fabric laundering process. Therefore, consumers view high suds volume as the primary and most desirable signal of cleaning. For hand-washing consumers, who are still the dominating majority in most developing countries, high suds volume are especially desirable, since the consumers can directly feel and touch suds generated during the hand-washing process and intuitively correlate high suds volume with sufficient fabric cleaning.

Paradoxically, high volume of suds during the wash cycle will typically translate to more suds in the subsequent rinse cycle. When consumers observe suds during the rinse cycle, they immediately infer from it that there may still be surfactant residue on the fabrics. Surfactant residue remaining on the fabrics may cause irritation to the skin, and it may also render the fabrics "sticky" after drying, thereby likely to attract more dirt upon wearing. Consequently, the consumers will feel the need to rinse the fabric a few more times, until suds are completely or substantially disappeared from the rinse solution, signaling that the fabrics are now "clean" and free of surfactant residue. However, oftentimes one or two rinses are sufficient to remove most or all of surfactant residue from the fabrics, despite a significant amount of suds remaining in the rinse solution. In other words, the additional rinses are unnecessary and excessive. Such excessive rinsing requires additional time, labor, energy and water. For regions where resources are scarce, especially those regions suffering from water shortage, excessive rinsing is particularly undesirable.

Therefore, a sudsing profile of a detergent composition during both wash and rinse cycles of the fabric laundering process is important for the overall consumer laundering experience, particularly for hand-washing consumers.

There is a need to provide consumers with an improved laundry cleaning (i.e., laundering) experience, especially those consumers who are accustomed to manually washing their laundry, either entirely (i.e., full manual/hand laundering) or in conjunction with machine washing (i.e., semi-automatic laundering). Specifically, this improved laundering experience is enabled by a desired sudsing profile defined by at least four (4) key points of consumer observation (hereinafter "touch points"), which jointly connote to the consumer that the laundry is sufficiently cleaned and rinsed. A failure at any one of these touch points may result in the consumer having a less than an ideal laundering experience.

These four (4) touch points, which are hereby labeled as "Flash Suds," "Suds Mileage," "Initial Rinse Suds," "End Rinse Suds," are explained hereinafter with reference to FIG. 1, which illustrates a typical laundering process with a wash cycle followed by a rinse cycle. Prior to the wash cycle, i.e., during a pre-wash step, a consumer will dissolve a laundry detergent product in a specific amount of water to form aqueous wash liquor, and the laundry to be treated will be brought into contact with the wash liquor.

The wash cycle starts with mechanical agitation of the laundry with the wash liquor, either in a washing machine or directly by the hands of the consumer, which leads to an initial bloom of suds that is characterized by a significantly high volume of suds (measured by height) generated at a relatively high speed (within the first 2-3 minutes of the wash cycle) during a first stage of the wash cycle, i.e., the "W-1" stage shown in FIG. 1. This initial bloom of suds, or the so-called "Flash Suds," constitutes the first touch point, which signals that the surfactant in the laundry detergent is working effectively to clean the laundry. The second touch point calls for sustainment or maintenance of the wash suds volume or height at a relatively level, i.e., the so-called "Suds Mileage," throughout a second, subsequent stage of the wash cycle (the "W-2" stage shown in FIG. 1).

These two initial touch points indicate to the consumer that the laundry detergent is efficacious in cleaning the laundry and remains so throughout the entire wash cycle. If there are no flash suds or if the flash suds volume is not high enough at the W-1 stage, then the consumer may interpret that the laundry detergent product as not being efficacious. If the suds mileage is not maintained throughout a significant portion of the W-2 stage of the wash cycle, the consumer may interpret that the laundry detergent product is losing cleaning efficacy or that there is not enough surfactant in the detergent to effectively clean the entire laundry bundle.

After the wash cycle and before the rinse cycle, i.e., during an in-between step, the sufficiently washed laundry is separated from the wash liquor. The wash liquor is drained or otherwise disposed. The laundry is wrung or spun to remove any excess wash liquor, followed by contacting the laundry with clean water or a rinse solution. The suds volume (measured by height) during this in-between step is inconsequential to the consumer, so it is not measured, and the dotted line only indicates the approximate suds volume (measure by height) during this step for illustration purposes.

During the rinse cycle, mechanical agitation (either by machine or by hand) is also applied to the laundry in the rinse solution, in attempt to rinse any carry-over or residue surfactant and soil off the laundry. At a first stage of the rinse cycle, i.e., the "R-1" stage in FIG. 1, some initial suds may be observed in the rinse solution, which is referred to as the "Initial Rinse Suds." A portion of such initial rinse suds as shown in FIG. 1 is carried over by the laundry from the wash cycle, i.e., residue suds attached to the laundry. The remaining portion of the initial rinse suds is generated by mechanical agitation of the rinse solution, due to the presence of carry-over or residue surfactant therein. Such initial rinse suds constitute the third touch point, which is preferably of a moderate volume (measured by height). The consumer expects to see some initial rinse suds, given the carryover of surfactant from the washed laundry. Complete absence of initial rinse suds may cause the consumer to doubt the efficacy of previous wash cycle.

The fourth touch point calls for fast and significant withering of suds (indicated by the dotted arrowhead) at a second, subsequent stage of the rinse cycle (the "R-2" stage of FIG. 1) that leads to a zero or near-zero "End Rinse Suds" volume (measured by height). Despite continued agitation, the rinse suds volume (measured by height) decreases significantly and quickly during this stage to a zero or near zero level. Note that both magnitude and speed of such suds decrease at the R-2 stage are important, because jointly they signal effective rinsing of the laundry. At the end of the R-2 stage, the rinse suds are eliminated or nearly eliminated, which connotes to the consumer that most or all of the residue surfactant has been rinsed off the laundry and he/she can move on to the post-rinse step, e.g., drying and/or ironing the laundry. Accordingly, the consumer can confidently stop rinsing and end the laundering process, which will help not only to save water but also to save the consumer's time.

During the R-2 stage, if the rinse suds decrease is not significant or fast enough to lead to zero or near-zero End Rinse Suds volume (measured by height), it connotes to the consumer that there is still residue surfactant in the washed laundry or the rinse solution. Consequently, the consumer feels that the rinse is not completed yet and may needlessly spend additional time rinsing and/or using additional rinse water until all of the suds are eliminated or nearly eliminated. Therefore, it is important that the fourth touch point is present to connote that the detergent product can be easily rinsed away from the washed laundry, i.e., it is an easy-rinse formulation, which can provide a key point of differentiation for laundry detergent products.

A laundry detergent product that provides an optimized sudsing profile at all four touch points discussed hereinabove connotes high cleaning efficacy as well as the easy rinse benefits of the laundry detergent product. It may also help the consumer to save water and/or may reduce the time the user takes in rinsing the laundry. Conventional laundry detergents may provide a laundering experience at one or more of these touch points, but never has a product provided consumers with an optimized sudsing profile at all four of these touch points (while also providing cleaning efficacy). Accordingly, there is a need for such a laundry detergent product.

SUMMARY OF THE INVENTION

The present invention provides a detergent composition comprising one or more surfactants in an amount ranging from 5 wt. % to 90 wt. %, while the detergent composition is characterized by an improved sudsing profile defined by: a) an Initial Wash Suds Volume of no less than about 30 cm; b) a Suds Mileage of no less than 30 cm; and c) a Rinse Suds Reduction Rate of no less than about 40%/min. The Initial Wash Suds Volume, the Suds Mileage, and the Rinse Suds Reduction Rate are all measured using the Sudsing Profile Test described hereinafter. The Initial Wash Suds Volume evaluates the first touch point, i.e, the "Flash Suds" volume (measured by height) as discussed hereinabove, during W-1 stage of the wash cycle. The Suds Mileage evaluates the second touch point as discussed hereinabove (therefore named after it), i.e., the suds volume measure by height, during W-2 stage of the wash cycle. The Rinse Suds Reduction Rate jointly evaluates the third and fourth touch points, i.e., the "Initial Rinse Suds" and "End Rinse Suds," as discussed hereinabove during R-1 and R-2 stages of the rinse cycle. Specifically, the Rinse Suds Reduction Rate measures the rate of suds volume reduction from the R-1 stage to the R-2 stage of the rinse cycle.

Further, the detergent composition is characterized by a unique surface tension profile defined as: (1) a First Order Surface Tension, as measured in a first aqueous solution of the detergent composition having a first total detergent concentration of about 5000 ppm; (2) a Second Order Surface Tension, as measured in a second aqueous solution of the detergent composition having a second total detergent concentration of about 333 ppm, wherein the difference between the First Order Surface Tension and the Second Order Surface Tension is no less than about 12 mN/m, preferably no less than about 13 mN/m, more preferably no less than about 14 mN/m, and most preferably no less than about 15 mN/m. The First Order Surface Tension and the Second Order Surface Tension are all measured using the Surface Tension Test described hereinafter.

The detergent composition of the present invention may contain various different surfactants, including, among others, a branched, unalkoxylated $C_6$-$C_{14}$ alkyl sulfate. Preferably, the branched, unalkoxylated $C_6$-$C_{14}$ alkyl sulfate is present in an amount ranging from about 1% to about 50%, and more preferably from about 5% to about 30%, by weight of the detergent composition. In addition, the detergent composition may contain one or more co-surfactants selected from the group consisting of:

(A) a linear or branched $C_4$-$C_{11}$ alkyl or aryl alkoxylated alcohol having a weight average degree of alkoxylation ranging from about 1 to about 10, and preferably said linear or branched $C_4$-$C_{11}$ alkyl or aryl alkoxylated alcohol is present in an amount ranging from about 0.05% to about 10%, and preferably from about 0.5% to about 5%, by weight of the detergent composition;

(B) a linear, unalkoxylated $C_6$-$C_{20}$ alkyl sulphate surfactant, and preferably said linear, unalkoxylated $C_6$-$C_{20}$ alkyl sulphate surfactant is present in an amount ranging from about 0.5% to about 30%, preferably from about 1% to about 20%, and more preferably from about 2% to about 15%, by total weight of the detergent composition;

(C) a $C_{10}$-$C_{20}$ linear alkylbenzene sulphonate, and preferably said linear alkylbenzene sulphonate is present in an amount ranging from about 0.5% to about 30%, preferably from about 1% to about 20%, and more preferably from about 2% to about 15%, by total weight of the detergent composition;

(D) a fatty acid or salt thereof, and preferably said fatty acid or salt thereof is present in an amount ranging from about 0.1% to about 10%, preferably from about 1% to about 8%, and more preferably from about 2% to about 6%, by total weight of the detergent composition; and (E) mixtures thereof.

Still further, the present invention relates to use of the above-described detergent compositions for hand-washing articles, such as fabrics or dishware. The unique sudsing profile of such detergent compositions of the present invention provides hand-washing consumers with a particularly delightful washing experience.

Still further, the present invention related to a method of treating a soiled material, including the steps of: (a) providing a detergent composition of the present invention; (b) contacting the detergent composition with at least a portion of the soiled material; and (c) rinsing the soiled material.

These and other features of the present invention will become apparent to one skilled in the art upon review of the following detailed description when taken in conjunction with the appended claims.

DETAILED DESCRIPTION OF THE INVENTION

Definitions

Figure 1:
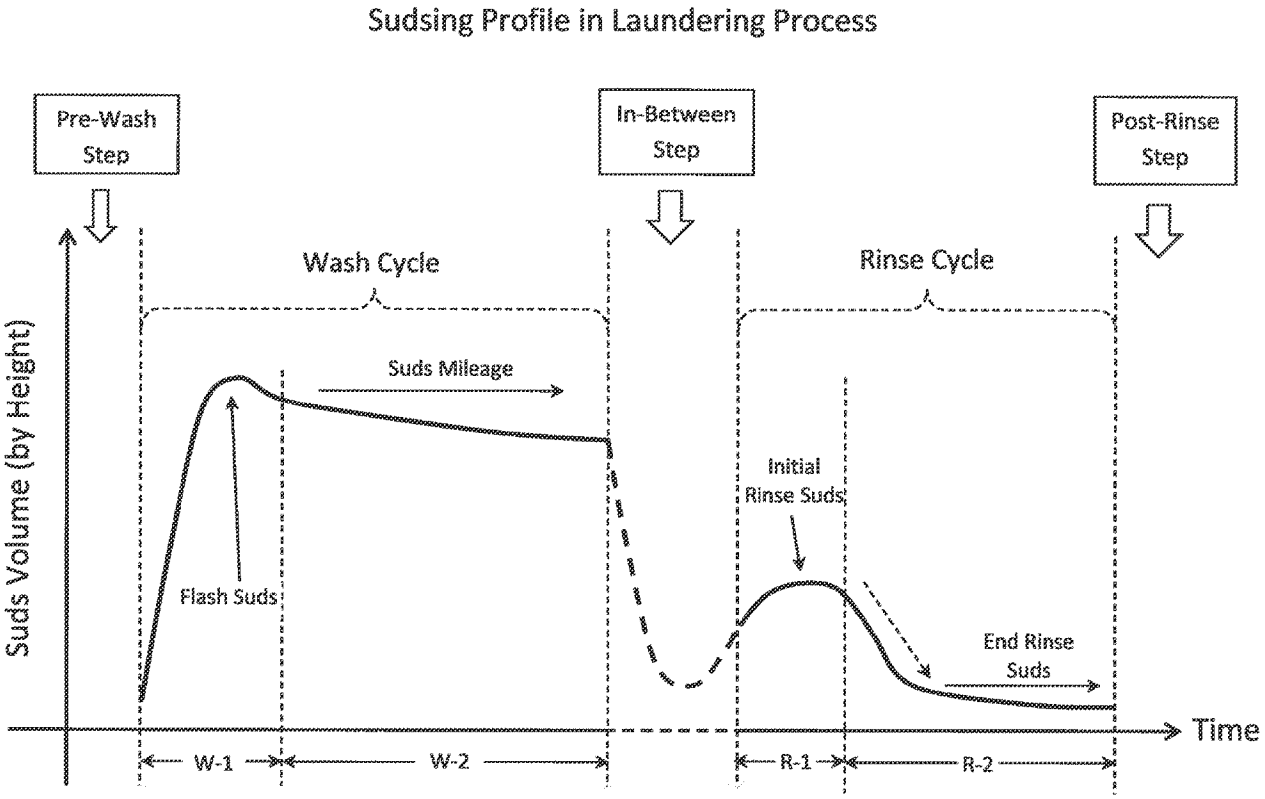
FIG. 1 is a graph illustrates a desired sudsing profile with four (4) touch points at various stages of the wash and rinse cycles of a laundering process.

As used herein, "suds" indicates a non-equilibrium dispersion of gas bubbles in a relatively smaller volume of a liquid. The terms like "suds", "foam" and "lather" can be used interchangeably within the meaning of the present invention.

As used herein, "sudsing profile" refers to the properties of a detergent composition relating to suds character during the wash and rinse cycles. The sudsing profile may include, but is not limited to: the initial speed of suds generation upon dissolution in a washing solution, the volume and retention of suds during the wash cycle, the look and feel of suds generated, the amount of residue suds carried over to the rinse solution, and the speed of suds reduction or disappearance during the rinse cycle, which are all connected with the fabric laundering experience of the consumers. Preferably, the sudsing profile may include Initial Wash Suds Volume (measured by height in centimeters), Suds Mileage (measured by height in centimeters), Wash Suds Retention Percentage (%), Rinse Suds at 0 Minute (volume measured by height in centimeters), Rinse Suds at 1 Minute (volume measured by height in centimeters), and Rinse Suds Reduction Rate (%/min), as measured by using the Sudsing Profile Test described hereinafter. More preferably, the sudsing profile of detergent compositions according to the present invention is defined by the Initial Wash Suds Volume (cm), the Suds Mileage (cm), and the Rinse Suds Reduction Rate (%/min), as measured by using the Sudsing Profile Test described hereinafter. These three parameters evaluate the four touch points as discussed hereinabove for the wash and rinse cycles. The sudsing profile may further include additional suds-related parameters.

As used herein, "First Order Surface Tension" of a detergent composition, such as a granular or liquid detergent composition, refers to surface tension measured for a first aqueous solution, which is formed by such detergent composition and has a first total detergent concentration of about 5000 ppm, by using the Surface Tension Test described hereinafter.

As used herein, "Second Order Surface Tension" of a detergent composition, such as a granular or liquid detergent composition, refers to surface tension measured for a second aqueous solution, which is formed by such detergent composition and has a second total detergent concentration of about 333 ppm, by using the Surface Tension Test described hereinafter.

As used herein, the term "detergent composition" refers to a composition with detersive effect for treating fabrics, dishware, hard surfaces and any other surfaces in the area of fabric and home care, including hard surface cleaners and/or floor and bathroom cleaners (e.g., toilet bowl cleaners); hand dishwashing agents or light duty dishwashing agents, especially those of the high-foaming type; machine dishwashing agents; personal care compositions; pet care compositions; automotive care compositions; and household care compositions. In one embodiment, the detergent composition of the present invention is a laundry detergent composition, which can be in liquid, powder, paste, gel, unit dose, pouch, or tablet form. In another embodiment, the detergent composition is a dish detergent composition, which also can be in liquid, powder, paste, gel, unit dose, pouch, or tablet form.

As used herein, the term "soiled material" is used non-specifically and may refer to any type of flexible material consisting of a network of natural or artificial fibers, including natural, artificial, and synthetic fibers, such as, but not limited to, cotton, linen, wool, polyester, nylon, silk, acrylic, and the like, as well as various blends and combinations. Soiled material may further refer to any type of hard surface, including natural, artificial, or synthetic surfaces, such as, but not limited to, surfaces of glass, metal, plastic, porcelain or ceramic cooking articles or utensils, and table, countertop or floor surfaces formed of tile, granite, grout, composite, vinyl, hardwood, and the like, as well as blends and combinations.

As used herein, the term "laundry detergent composition" is a subset of "detergent composition", and includes all-purpose or "heavy-duty" washing agents for fabric, especially detergents in liquid, powder, paste, gel, unit dose, pouch, or tablet form, as well as cleaning auxiliaries such as bleach, rinse aids, additives or pre-treat types. In one embodiment, the laundry detergent composition is a free-flowing granular laundry detergent; and in another embodiment, the laundry detergent composition is a heavy duty liquid laundry detergent.

As used herein, the term "total detergent concentration" refers to the concentration by weight of a detergent composition in an aqueous solution, which is formed by dissolving a detergent composition in water, which can be expressed either in milligram per liter (mg/L), milligrams per kilogram (mg/Kg), or parts-per-million (ppm). Preferably, the total detergent concentration is expressed in parts-per-million. For example, when an aqueous solution is formed by dissolving 5 grams of a detergent composition in 1 liter of water, the total detergent concentration in such aqueous solution is calculated as (5 grams)/L=500 mg/L, or (5 grams)/(1 L×1 Kg/L)=5000 mg/Kg or 5000 ppm. For calculating the total detergent concentration in an aqueous solution, it is assumed that such aqueous solution has a density equivalent to water, i.e., 1 kilogram per liter.

As used herein, the term "$C_4$-$C_{11}$ alkyl or aryl alkoxylated alcohol" refers broadly to alkoxylated alcohol that contains at least one $C_4$-$C_{11}$ alkyl group with a linear or branched structure, or a $C_4$-$C_{11}$ aryl group. In other words, $C_4$-$C_{11}$ defines the total carbon number of the alkyl or aryl group, not the total carbon number of the alkoxylated alcohol compound. The $C_4$-$C_{11}$ aryl group can be either unsubstituted or substituted with an alkyl group that is either linear or branched, provided that the total carbon number of this group does not exceed 11. If the $C_4$-$C_{11}$ aryl group contains an alkyl substitution, the $C_4$-$C_{11}$ aryl group can be connected to the alkoxylated alcohol either through a ring carbon or through the alkyl substitution.

As used herein, articles such as "a" and "an" when used in a claim, are understood to mean one or more of what is claimed or described.

As used herein, the terms "comprising," "comprises," "include", "includes" and "including" are meant to be non-limiting. The term "consisting of" is meant to be limiting, i.e., excluding any components or ingredients that are not specifically listed except when they are present as impurities. The term "consisting essentially of," on the other hand, allows the presence of other components or ingredients as long as they do not interfere with the functions of those components or ingredients that are specifically listed.

As used herein, the term "substantially free of" or "substantially free from" refers to the presence of no more than 0.5%, preferably no more than 0.2%, and more preferably no more than 0.1%, of an indicated material in a composition, by total weight of such composition.

As used herein, the term "essentially free of" means that the indicated material is not deliberately added to the composition, or preferably not present at analytically detectable levels. It is meant to include compositions whereby the indicated material is present only as an impurity of one of the other materials deliberately added.

As used herein, the term "solid" includes granular, powder, bar and tablet product forms.

As used herein, the term "fluid" includes liquid, gel, paste and gas product forms.

As used herein, the term "liquid" refers to a fluid having a liquid having a viscosity of from about 1 to about 2000 mPa*s at 25° C. and a shear rate of 20 $sec^{-1}$. In some embodiments, the viscosity of the liquid may be in the range of from about 200 to about 1000 mPa*s at 25° C. at a shear rate of 20 $sec^{-1}$. In some embodiments, the viscosity of the liquid may be in the range of from about 200 to about 500 mPa*s at 25° C. at a shear rate of 20 $sec^{-1}$. The viscosity can be determined using a Brookfield viscometer, No. 2 spindle, at 60 RPM/s.

All temperatures herein are in degrees Celsius (° C.) unless otherwise indicated. Unless otherwise specified, all measurements herein are conducted at 20° C. and under the atmospheric pressure.

In all embodiments of the present invention, all percentages are by weight of the total composition, unless specifically stated otherwise. All ratios are weight ratios, unless specifically stated otherwise. The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

It is understood that the test methods that are disclosed in the Test Methods Section of the present application must be used to determine the respective values of the parameters of Applicants' inventions are described and claimed herein.

Sudsing Profile

Inventors of the present invention have discovered a group of detergent compositions that are characterized by a unique and improved sudsing profile, which delights the consumer at all four (4) touch points during different stages of the wash and rinse cycles, as explained hereinabove in connection with FIG. 1. Specifically, the sudsing profile of the present invention is characterized by a high "Flash Suds" volume at the W-1 stage and good "Suds Mileage" at the W-2 stage of the wash cycle, a moderate amount of "Initial Rinse Suds" at the R-1 stage of the rinse cycle, and a drastically faster reduction and disappearance of rinse suds leading to zero or near-zero "End Rinse Suds" at the R-2 stage of the rinse cycle.

Such a unique sudsing profile provides hand-wash consumers with delightful washing and rinsing experience, especially during the rinse stage. The volume of suds generated and sustainability/stability thereof during the wash cycle are sufficiently high, thereby signaling to the consumer that effective cleaning is occurring. A moderate amount of suds is observed at the beginning of the rinse cycle, which is expected by the consumer after observing a large amount of suds generated during the wash as a sign of effective cleaning. However, once the rinse cycle starts, the suds undergo drastic and fast reduction and disappearance during the first one or two minutes of rinsing. Consumers, especially the ones conducting hand-wash, will have the chance to visually observe the drastic and fast reduction and disappearance of rinse suds, eventually resulting in a clear rinse solution with little or no suds at the end of the first rinse cycle. The visual perception of suds reduction and disappearance by the consumers provides a clear signal that the article to be cleansed has gone through effective cleaning and sufficient rinsing, and is now free of soil as well as residue surfactant. Therefore, the consumers will confidently stop the laundering process after the first rinse cycle, thus eliminating the need for additional rinses and potentially enabling the concept of single rinse.

The surprising and unexpected sudsing profile achieved by the detergent compositions of the present invention is specifically characterized by a high Initial Wash Suds Volume, a high Suds Mileage, a high Wash Suds Retention Percentage, and a high Rinse Suds Reduction Rate, as measured by using the Sudsing Profile Test described hereinafter.

Specifically, the unique sudsing profile is defined by: a) an Initial Wash Suds Volume (measured by height) of no less than about 30 cm; b) a Suds Mileage (measured by height) of no less than about 30 cm; and c) a Rinse Suds Reduction Rate of no less than about 40%/min, which are measured using the Sudsing Profile Test described hereinafter.

The Initial Wash Suds Volume can be as high as about 50 cm, so it may range from about 30 cm to about 50 cm. Preferably, the Initial Wash Suds Volume of the detergent composition is no less than about 35 cm, preferably no less than about 40 cm, and more preferably no less than about 45 cm. More preferably, the Initial Wash Suds Volume ranges from about 35 cm to about 49 cm, preferably from about 40 cm to about 48 cm, and more preferably from about 45 cm to about 47 cm.

The Suds Mileage also has an upper limit of about 50 cm, so it may also range from about 30 cm to about 50 cm. Preferably, the Suds Mileage of the detergent composition is no less than about 35 cm, preferably no less than about 37 cm, and more preferably no less than about 40 cm. More preferably, the Suds Mileage ranges from about 35 cm to about 48 cm, preferably from about 37 cm to about 46 cm, and more preferably from about 40 cm to about 45 cm.

The Wash Suds Retention Percentage, which is calculated based on the Initial Wash Suds Volume and the Suds Mileage, may range from 60% to 120%. Preferably, it is no less than 70%, or no less than 80%, or no less than 90%, or no less than 100%. More preferably, the Wash Suds Retention Percentage ranges from about 70% to about 110%, still more preferably from about 80% to about 110% or from about 90% to about 110%, and most preferably from about 100% to 110%.

The Rinse Suds Reduction Rate preferably ranges from about 40%/min to 100%/min. Preferably it ranges from about 50%/min to 100%/min. More preferably, it ranges from about 60%/min to 100%/min. Still more preferably, it ranges from about 70%/min to 100%/min. Yet more preferably, it ranges from about 80%/min to 100%/min. Most preferably, the Rinse Suds Reduction Rate of the detergent composition of the present invention is 100%/min. This means that within one (1) minute from when the rinse cycle starts, all suds in the rinse solution disappear, resulting in a "zero suds" rinse solution. This is most extraordinary, because the rapid rinse reduction right before the consumer's eyes sends a strong visual signal to the consumer the rinse solution is now clear and that the rinse can be stopped.

The sudsing profile of the detergent compositions of the present invention has been measured against several in-market laundry detergent products (in both powder and liquid formulations), and has proven to be superior over such in-market products. Specifically, none of the in-market products exhibit a Rinse Suds Reduction Rate higher than 20%/min, and several actually exhibit a Rinse Suds Reduction Rate of 0%/min, i.e., no suds reduction is observed during the first minute of the rinse cycle.

Surface Tension Profile

Without being bound by any theory, it is believed that a unique surface tension profile of the detergent compositions of the present invention enables the above-described surprising and unexpected sudsing profile.

Surface tension of a liquid is caused by cohesive forces between liquid molecules. Within a liquid, each liquid molecule is subjected to substantially equal amount of cohesive forces from neighboring liquid molecules surrounding it. Therefore, the cohesive forces between liquid molecules mostly cancel each other out. However, at the liquid-air interface, the liquid molecules do not have the similar neighboring liquid molecules on all sides, and they tend to cohere more strongly with neighboring liquid molecules directly associated them on the surface. This results in an inward force at the liquid-air interface that causes the liquid to behave as if its surface were covered by a stretched elastic surface "film."

The surface tension of a liquid is relevant to formation and stability of bubbles or suds at the liquid-air interface. If the surface tension is too high, no stable bubbles or suds can be formed at the liquid-air interface. For example, pure water has a high surface tension of about 72.8 millinewtons per meter (mN/m) at 20° C., in comparison with most other liquids, because of the relatively high attraction or cohesive forces between water molecules. Therefore, bubbles or suds formed by pure water tend to be very unstable. Surfactants are molecules that can effectively reduce the surface tension of water when dissolved, and allows formation of more stable bubbles or suds. The lower the surface tension at the air-water interface, the more stable the bubbles or suds.

Therefore, during the wash cycle of a fabric laundering or dish washing process, low surface tension is needed for optimized generation and stabilization of a large volume of suds. However, during the rinse cycle, higher surface tension is needed, so that suds generation can be suppressed, and the stability of any generated suds can be minimized (i.e., the suds burst as quickly as they are generated).

Because detergent compositions will undergo dilutions from the wash cycle to the rinse cycle during a fabric laundering or dish washing process, it is particularly desirable to provide an inventive detergent composition having a surface tension profile that changes quickly and drastically from very low to very high when it is diluted from the wash cycle to the rinse cycle.

Specifically, it is desirable to provide an inventive detergent composition characterized by: (1) a First Order Surface Tension ("$1^{st}$ Order ST"), which is measured in a first aqueous solution of said detergent composition having a first total detergent concentration of 5000 ppm according to the Surface Tension Test described hereinafter; and (2) a Second Order Surface Tension ("$2^{nd}$ Order ST"), which is measured in a second aqueous solution of said detergent composition having a second total detergent concentration of 333 ppm also according to the Surface Tension Test described hereinafter, while the difference between the $1^{st}$ Order ST and the $2^{nd}$ Order ST ("ΔST") is no less than about 12 mN/m, preferably no less than about 13 mN/m, more preferably no less than about 14 mN/m, and most preferably no less than about 15 mN/m.

The ΔST has an approximate upper limit of about 52 mN/m, so it may range from about 12 mN/m to about 52 mN/m, preferably from about 13 mN/m to 52 mN/m, more preferably from about 14 mN/m to about 52 mN/m, and most preferably from about 15 mN/m to about 52 mN/m.

The $1^{st}$ Order ST of the detergent composition of the present invention may range from about 20 mN/m to about 40 mN/m, preferably from about 20 mN/m to about 35 mN/m, more preferably from about 20 mN/m to about 30 mN/m, and most preferably from about 20 mN/m to about 28 mN/m. Without being bound by any theory, it is believed that the lower the $1^{st}$ Order ST, the higher the volume of wash suds that is generated by the detergent composition, and the more stable the suds are during the wash cycle.

The $2^{nd}$ Order ST of the detergent composition of the present invention may range from about 35 mN/m to about 72 mN/m, preferably from about 37 mN/m to about 72 mN/m, more preferably from about 40 mN/m to about 72 mN/m, and most preferably from about 42 mN/m to about 72 mN/m. Without being bound by any theory, it is believed that the higher the $2^{nd}$ Order ST, the lower the volume of suds that is carried from wash to rinse, and the faster the suds collapse and disappear during the rinse cycle.

Surfactant System

The detergent compositions of the present invention as described hereinabove may comprise one or more surfactants in an amount ranging from about 5% to about 90% by total weight of the detergent composition. The one or more surfactants may include any surfactant(s) selected from the group consisting of anionic surfactants, nonionic surfactants, cationic surfactants, zwitterionic surfactants, amphoteric surfactants, and mixtures thereof, as long as the resulting detergent composition is capable of delivering the superior sudsing profile as described hereinabove.

In a preferred, but not necessary, embodiment of the present invention, the detergent composition includes a primary surfactant in combination with one or more co-surfactants at specific amounts and weight ratios, as described hereinafter:

Primary Surfactant: Branched, Unalkoxylated $C_6$-$C_{14}$ Alkyl Sulfates (BAS)

The primary surfactant suitable for the practice of the present invention can be an anionic surfactant selected from the group consisting of branched, unalkoxylated $C_6$-$C_{14}$ alkyl sulfates (hereinafter "BAS").

It is important that the BAS surfactant of the present invention is unalkoxylated, because alkoxylation, even at a relatively low degree (e.g., a weight average degree of about 1), may adversely affect the Rinse Suds Reduction Rate of the resulting detergent composition. Therefore, it is desirable to employ unalkoxylated alkyl sulfate surfactants instead.

Branching of the $C_6$-$C_{14}$ alkyl chain in the BAS surfactant is also important, because linear alkyl sulfates have poorer suds stability during the wash cycle, which in turn leads to significantly lower Suds Mileage. Therefore, it is desirable to employ branched alkyl sulfate surfactants instead.

Further, the BAS surfactants of the present invention are characterized by relatively short alkyl chains, i.e., with from about 6 to about 14 carbon atoms. Alkyl sulfate surfactants with longer alkyl chain may lead to a significantly lower Rinse Suds Reduction Rate in the resulting detergent composition. Therefore, it is desirable to employ BAS surfactants with relatively short alkyl chains (i.e., $C_6$-$C_{14}$), and preferably their branched alkyl moieties are characterized by a weight average carbon number ranging from about 9 to about 14, more preferably from about 10 to about 13, and most preferably from about 11 to about 13.

The BAS surfactants of the present invention may exist in an acid form, while the acid form may be neutralized to form a salt. Typical agents for neutralization include metal counterion bases, such as hydroxides, e.g., NaOH or KOH. Further suitable agents for neutralizing anionic surfactants in their acid forms include ammonia, amines, or alkanolamines. Non-limiting examples of alkanolamines include monoethanolamine, diethanolamine, triethanolamine, and other linear or branched alkanolamines known in the art; suitable alkanolamines include 2-amino-1-propanol, 1-aminopropanol, monoisopropanolamine, or 1-amino-3-propanol. Amine neutralization may be done to a full or partial extent, e.g., part of the anionic surfactant mix may be neutralized with sodium or potassium and part of the anionic surfactant mix may be neutralized with amines or alkanolamines.

In a preferred but not necessary embodiment of the present invention, the BAS surfactants have the general formula (I):

(I)

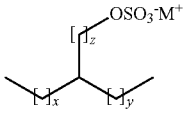

while M is a cation of alkali metal, alkaline earth metal, ammonium, amine or alkanolamine; x and y are independently selected from integers ranging from 0 to about 10; z is an integer ranging from about 1 to about 4; the sum of x+y is equal to or greater than z; and the sum of x+y+z ranges from about 3 to about 11. Preferably, z is about 1, and the sum of x+y is from about 8 to about 9.

Non-limiting examples of suitable branched, unalkoxylated AS surfactants of the present invention include those having the following chemical structures:

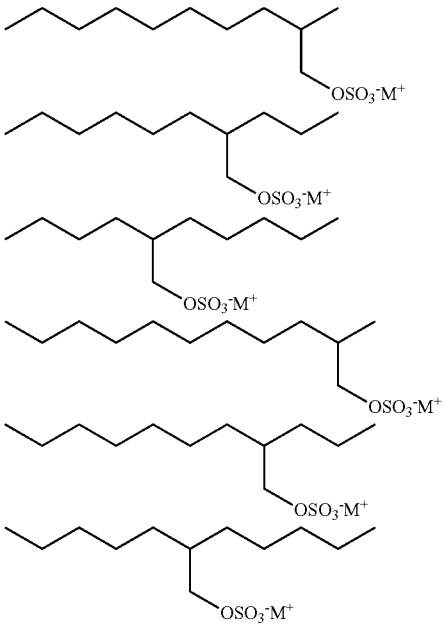

-continued

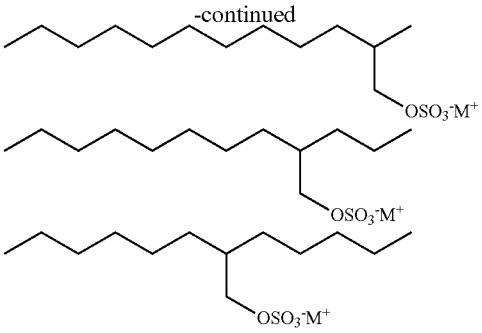

It is particularly preferred that the detergent composition of the present invention contains a mixture of two or more BAS surfactants. More preferably, such a mixture includes: (1) a $C_{12}$ BAS surfactant in the amount ranging from about 20% to about 80%, preferably from about 30% to about 70%, and more preferably from about 35% to about 50%, by total weight of the mixture; and (2) a $C_{13}$ BAS surfactant in the amount ranging from about 20% to about 80%, preferably from about 30% to about 70%, and more preferably from about 35% to about 50%, by total weight of the mixture. Most preferably, the mixture is consisting of or consisting essentially of the $C_{12}$ and $C_{13}$ BAS surfactants.

BAS surfactants as described hereinabove are commercially available as a mixture of linear isomer and branched isomer with a variety of chain lengths and degrees of branching, which include but are not limited to sulphated Isalchem® 123 from Sasol with $C_{12-13}$ chain length distribution and about 95% branching, and Neodol® 123 AS from Shell with $C_{12-13}$ chain length distribution and about 20% branching.

The detergent composition of the present invention may contain the BAS surfactants as described hereinabove in an amount ranging from about 1% to about 50%, preferably from about 2% to about 40%, more preferably from about 5% to about 30%, and most preferably from about 10% to about 20%, by total weight of the detergent composition. In more concentrated formulations with 2×, 3×, or 4× compaction ratios, the BAS surfactants may be present in higher amounts ranging from 30% to 50%, preferably from 35% to 45%, and more preferably from 40% to 45% by weight of the concentrated formulations.

Little or No Alkoxylated Alkyl Sulfate (AxS)

The detergent composition of the present invention is substantially free of alkoxylated alkyl sulfate (AxS) surfactants, either linear or branched. Preferably, the detergent composition of the present invention is essentially free of any AxS. The presence of AxS, even at a level as low as 1 wt. %, may significantly affect the Rinse Suds Reduction Rate. An insignificant amount of AxS (e.g., no more than 0.5 wt. %) seems to be tolerable.

Co-Surfactant (A): Short Chain Alkoxylated Alcohols ("Short Chain AA")

The detergent composition of the present invention may comprise one or more nonionic surfactants as co-surfactants for the BAS surfactants described hereinabove. Nonionic surfactants particularly suitable for the practice of the present invention are short chain alkoxylated alcohols ("Short Chain AA"), either linear or branched.

The Short Chain AA of the present invention contains a relatively short carbon chain or a relatively small aromatic ring, i.e., $C_4$-$C_{11}$ alkyl or aryl moieties, preferably $C_4$-$C_{10}$ alkyl or aryl moieties, more preferably $C_4$-$C_8$ alkyl or aryl moieties, and most preferably $C_4$-$C_6$ alkyl or aryl moieties. The $C_4$-$C_{11}$ aryl moiety of the Short Chain AA surfactant can be either unsubstituted or substituted with an alkyl group that is either linear or branched, provided that the total carbon number of this group does not exceed 11. If the $C_4$-$C_{11}$ aryl moiety contains an alkyl substitution, the $C_4$-$C_{11}$ aryl moiety can be connected to the alkoxylated alcohol either through a ring carbon or through the alkyl substitution. Preferably, the Short Chain AA surfactant used in the practice of the present invention contains a $C_4$-$C_{11}$ alkyl moiety.

Nonionic alkoxylated alcohol ("AA") surfactants with longer carbon chains, such as those with $C_{12}$-$C_{20}$ alkyl moieties, exhibit a significantly lower Rinse Suds Reduction Rate as well as a lower Suds Mileage relative to the Short Chain AAs, when in combination with the BAS anionic surfactants. Therefore, it is desirable to employ the Short Chain AA surfactants as described hereinabove instead.

The Short Chain AA surfactants of the present invention may comprise one or more alkoxylated moieties. Such alkoxylated moieties may be either linear or branched. Each of such alkoxylated moieties may contain from 1 to 10 carbon atoms. Preferably, the alkoxylated moieties are selected from the group consisting of methoxy, ethoxy, propoxy, butoxy, pentoxy, hexoxy, and mixtures thereof. The weight average degree of alkoxylation in the Short Chain AA, i.e., the weight average number of alkoxylated moieties contained by the Short Chain AA, may range from about 1 to about 10, preferably from about 2 to about 8, more preferably from about 3 to about 7, and most preferably from about 4 to about 6.

The Short Chain AA surfactants of the present invention may have the following general formula (II):

$$R^1\text{—}\underset{R^3}{O}\text{—}(CH_2\text{—}CHR^2\text{—}O)_n\text{—}(CH_2\text{—}CH_2\text{—}O)_m\text{—} \quad \text{(II)},$$

wherein $R^1$ is linear or branched $C_4$-$C_{11}$ alkyl or aryl, such as phenyl or substituted phenyl; $R^2$ is linear or branched $C_1$-$C_8$ alkyl; $R^3$ is hydrogen, linear or branched $C_1$-$C_6$ alkyl, benzoyl, acetyl, acryloyl or methacryloyl; n has a weight average value ranging from 0 to about 5; m has a weight average value ranging from about 1 to about 10; m>n and n+m is less than or equal to about 10.

Preferably, $R^1$ is $C_4$-$C_{11}$ alkyl, more preferably $C_4$-$C_{10}$ alkyl, and still more preferably $C_4$-$C_8$ alkyl, and most preferably $C_4$-$C_6$ alkyl. In a particularly preferred embodiment of the present invention, $R^1$ is linear $C_4$-$C_{11}$ alkyl, more preferably linear $C_4$-$C_{10}$ alkyl, and still more preferably linear $C_4$-$C_8$ alkyl, and most preferably linear $C_4$-$C_6$ alkyl.

In an alternative embodiment of the present invention, $R^1$ is preferably phenyl or substituted phenyl. Substitutes on the phenyl radical can be linear or branched $C_1$-$C_5$ alkyls, which can optionally be further substituted with one or more function groups selected from the group consisting of amido, imido, carboxylic ester, halide and ether. Preferably, the substitute on the phenyl radical is an unsubstituted $C_1$-$C_5$ alkyl group.

Particularly preferred $R^1$ radicals are derived from the following alcohols: hexanol, phenol, butanols (especially n-butanol and isobutanol), pentanols, ter-amyl alcohol, heptanols, octanols (specially n-octanols and 2-ethylhexanol), isononanol, decanol, isodecanol, 2-propylheptanol, and mixtures thereof. In addition, it is possible to use a mixture of a $C_4$-$C_8$ alcohol cut or a $C_5$-$C_9$ alcohol cut.

$R^2$ is preferably $C_1$-$C_4$ alkyl, more preferably either methyl or ethyl, and most preferably methyl.

$R^3$ is preferably hydrogen or $C_1$-$C_4$ alkyl, and more preferably hydrogen, methyl or ethyl, and most preferably hydrogen. The radical $R^3$, if it is other than hydrogen, serves as what is typically referred to as an end group cap in order to stabilize the Short Chain AA surfactants, when it is in an alkaline solution, for example.

The values n and m represent weight average values, since in the alkoxylation of alcohols, generally a distribution of the degree of alkoxylation is obtained. The sum of n+m is preferably from about 2 to about 8, more preferably from about 3 to about 7, and most preferably from about 4 to about 6. This means that the total weight average degree of alkoxylation in the Short Chain AA surfactants of the present invention may range from about 2 to about 8, preferably from about 3 to about 7, and more preferably from about 4 to about 6.

In a preferred embodiment, n has a weight average value (hereinafter simply referred to as the value of n) of less than or equal to about 2, and m has a weight average value (hereinafter simply referred to as the value of m) ranging from about 3 to about 10. In a particularly preferred embodiment of the present invention, n is 0, which means that the Short Chain AA surfactants of the present invention are primarily ethoxylated. In this event, m may preferably range from 2 to about 8, more preferably from about 3 to about 7, and most preferably from about 4 to about 6.

In a further preferred embodiment, n is 0 and m ranges from about 3 to about 9 when $R^1$ is phenyl. In a still further preferred embodiment, n is less than or equal to about 2, and m ranges from about 3 to about 6 when $R^1$ is a $C_4$-$C_6$ alkyl.

If both alkoxylation groups, i.e., the $CH_2$—$CHR^2$—O— and the $CH_2$—$CH_2$—O— groups, are present in such Short Chain AA surfactants, they can be distributed either randomly or in blocks. These alkoxylation groups are introduced into the Short Chain AA surfactants of the present invention by reaching the corresponding alcohols $R^1$—OH with an alkylene oxide compound selected from the group consisting of ethylene oxide, propylene oxide, butylene oxide, pentylene oxide, and the like. Preferably, the compound is selected from the group consisting of ethylene oxide, propylene oxide, and mixture thereof. When different alkylene oxides are used, the reaction can be carried out with the different alkylene oxides arranged in blocks (successively or alternately) or simultaneously (random or mixed).

The following are exemplary Short Chain AA surfactants for practice of the present invention: ethoxylated butanol with a weight average EO value of about 3; ethoxylated butanol with a weight average EO value of about 4; ethoxylated butanol with a weight average EO value of about 5; ethoxylated butanol with a weight average EO value of about 6; ethoxylated hexanol with a weight average EO value of about 3; ethoxylated hexanol with a weight average EO value of about 4; ethoxylated hexanol with a weight average EO value of about 5; ethoxylated hexanol with a weight average EO value of about 6; ethoxylated phenol with a weight average EO value of about 3; ethoxylated phenol with a weight average EO value of about 4; ethoxylated phenol with a weight average EO value of about 5; ethoxylated phenol with a weight average EO value of about 6; and the like. The stated EO values are rounded. Particularly preferred are the Short Chain AA surfactants based on hexanol and phenol.

Commercially available Short Chain AA surfactants that can be used for practicing the present invention include, but are not limited to: Emulan® HE50 from BASF, which is a $C_6$ alcohol with a weight average number of ethoxylation of about 5; and EcoSurf® 6 from Dow Chemical, which is a $C_8$ alcohol with a weight average number of ethoxylation of about 6.

If present, the Short Chain AA surfactants as described hereinabove may be present in the detergent composition of the present invention in an amount ranging from about 0.05% to about 10%, preferably from about 0.1% to about 6%, more preferably from about 0.5% to about 5%, and most preferably from about 1% to about 4%, by total weight of the detergent composition. In more concentrated formulations with 2×, 3×, or 4× compaction ratios, the Short Chain AA surfactants may be present in higher amounts ranging from 15% to 30%, and preferably from 20% to 25%, by weight of the concentrated formulations.

Weight Ratio Between the BAS and the Short Chain AA Surfactants

The weight ratio of the above-described BAS surfactants to the Short Chain AA surfactants is preferably in the range of from about 20:1 to about 1:2, more preferably from about 10:1 to about 1:1, still more preferably from about 5:1 to about 2:1, and most preferably from 5:1 to 4:1. Different weight ratios of the BAS surfactants to the Short Chain AA surfactants may influence the sudsing profile of the resulting detergent composition. When such weight ratio is above 1:1 (i.e., there are more BAS surfactants in the detergent composition than the Short Chain AA surfactants), preferably above 2:1, more preferably from about 4:1 to about 5:1, the wash suds stability improves, and better Suds Mileage can be achieved during the wash cycle.

Co-Surfactant (B): Linear, Unalkoxylated $C_6$-$C_{20}$ Alkyl Sulfate ("AS")

The detergent composition of the present invention may comprise one or more anionic surfactants as co-surfactants for the BAS surfactants described hereinabove.

One type of anionic surfactants particularly suitable for the practice of the present invention are linear, unalkoxylated $C_6$-$C_{20}$ alkyl sulfate surfactants. The AS surfactants of present invention have the general formula of $R—O—SO_3^- M^+$, wherein R is a linear alkyl group having from about 6 to about 20 carbon atoms, and wherein M is a cation of alkali metal, alkaline earth metal or ammonium. Preferably, the AS surfactants are what are typically referred to as "Mid-Cut AS" or "MCAS" surfactants with R groups having from about 6 to about 18 carbon atoms, more preferably from about 6 to about 16 carbon atoms, and most preferably from about 12 to about 16 carbon atoms. MCAS surfactants are particularly advantageous in providing an improved sudsing profile with better rinse benefit.

As mentioned hereinabove, the detergent composition of the present invention is substantially free of alkoxylated alkyl sulfate (AxS) surfactants, either linear or branched, due the negative impact of the AxS surfactants on the sudsing profile, especially on the rinse suds reduction rate. Therefore, R is essentially free of any of any alkoxylation units.

Preferably, the AS surfactants are enriched with $C_6$-$C_{14}$, i.e., they contain from 80% to 100%, preferably from 85% to 100%, and more preferably from 90% to 100%, by weight of one or more linear, unalkoxylated $C_6$-$C_{14}$ alkyl sulfate surfactants. More preferably, the AS surfactants are enriched with $C_{8-14}$, i.e., they contain from 80% to 100%, preferably from 85% to 100%, and more preferably from 90% to 100%, by weight of one or more linear, unalkoxylated $C_8$-$C_{14}$ alkyl sulfate surfactants. Still more preferably, the AS surfactants are enriched with $C_{10-14}$, i.e., they contain from 80% to 100%, preferably from 85% to 100%, and more preferably from 90% to 100%, by weight of one or more linear, unalkoxylated $C_{10-14}$ alkyl sulfate surfactants. Most preferably, the AS surfactants are enriched with $C_{12-14}$, i.e., they contain from 80% to 100%, preferably from 85% to 100%, and more preferably from 90% to 100%, by weight of one or more linear, unalkoxylated $C_{12-14}$ alkyl sulfate surfactants.

In a particularly preferred embodiment of the present invention, the AS surfactants are enriched with $C_{12}$, i.e., they comprise from 30% to 100%, more preferably from 50 to 99% or from 60 to 95% or from 65 to 90%, and most preferably from 70 to 80% by weight of a linear, unalkoxylated $C_{12}$ alkyl sulfate surfactant.

The AS surfactants of the present invention may also be particularly enriched with $C_{14}$, i.e., containing from 10% to 100%, or from 20 to 50%, or even from 25 to 30% by weight of a linear, unalkoxylated $C_{14}$ alkyl sulfate surfactant.

The AS surfactants of the present invention may comprise more than 50%, in particular more than 60%, for example more than 70%, typically more than 80 or 90%, or substantially 100% of alkyl sulphate surfactants having an alkyl chain comprising an even number of carbon atoms.

In a preferred but non-limiting embodiment of the present invention, the detergent composition contains a mixture of two or more AS surfactants. More preferably, such a mixture includes: (1) a linear, unalkoxylated $C_{12}$ alkyl sulfate surfactant in the amount ranging from 30% to 100%, preferably from 60% to 95%, and more preferably from 70% to 80%, by total weight of the mixture; (2) a linear, unalkoxylated $C_{14}$ alkyl sulfate surfactant in the amount ranging from 0% to 70%, preferably from 5% to 40%, and more preferably from 20% to 30%, by total weight of the mixture; and (3) a linear, unalkoxylated $C_{16}$ alkyl sulfate surfactant in the amount ranging from 0% to 20%, preferably from 1% to 15%, and more preferably from 4% to 10% by total weight of the mixture. It is still more preferred that this mixture contains less than 10%, preferably less than 5%, and more preferably less than 2% of alkyl sulfate surfactants having either 18 carbon atoms or more, or 10 carbon atoms or less, by total weight of the mixture.

The AS surfactants of the present invention may be obtained by the sulfonation of the corresponding alcohol(s). The required carbon chain length distribution can be obtained by using alcohols with the corresponding chain length distribution prepared synthetically or from natural raw materials or corresponding pure starting compounds. For example, palm kernel oil and coconut oil comprising triglycerides can be chemically processed to obtain a mixture of $C_{12}$-$C_{18}$ alcohols which usually comprise more than 20% of $C_{16}$-$C_{18}$ alcohols. The alcohols may be sulphated to obtain alkyl sulphates. A mixture of AS comprising a lower proportion of $C_{16}$-$C_{18}$ alkyl sulphates may be obtained by separating the corresponding alcohols before the sulphatation step or by separating the obtained alkyl sulphate surfactant(s) after the sulphatation step.

The AS surfactants of the present invention can also be formed by using metathesis oils that are naturally derived, which can provide a mixture of AS surfactants with alkyl chain lengths characterized by a biologically determined distribution. For example, soybean oil, canola oil, jatropha oil, palm oil, algae oil, or the like can be co-metathesized with 3-hexene to form a mixture containing mostly $C_{12}$ esters. It is also preferred that algae oil of high stability with a desired fatty acid distribution, which can be produced by recombinant DNA technology as described in various patents assigned to Solazyme, is used to form the AS surfactants of the present invention. Alternatively, the above described naturally-derived oils can be co-metathesized with 3-hexene and 2-hexene to form a mixture of $C_{11}$, $C_{12}$, $C_{13}$ esters with a weight ratio of approximately 1:2:1. Alternatively, the above described naturally-derived oils can be co-metathesized with 3-hexene and 4-octene to form a mixture containing mainly $C_{12}$ and $C_{13}$ esters in any desired weight ratio (by controlling the 3-hexene and 4-octene mix ratio). Alternatively, the above described naturally-derived oils can be co-metathesized with a mixture containing 70 wt. % 1-butene and 30 wt. % hexane to form a mixture of $C_{12}$ and $C_{14}$ fatty acid esters at a weight ratio of approximately 70:30 (there will be small amount of $C_{13}$ and $C_{15}$ esters in the mixture). The esters so formed are then reduced to fatty alcohols, which is subsequently sulfated to form the AS surfactants of the present invention.

If present, the AS surfactants as described hereinabove may be present in the detergent composition of the present invention in an amount ranging from about 0.5% to about 30%, preferably from about 1% to about 20%, more preferably from about 2% to about 15%, and most preferably from about 3% to about 10%, by total weight of the detergent composition. In a most preferred embodiment of the present invention, the detergent composition contains from about 3% to about 5 wt. % of an AS surfactant mixture consisting essentially of from about 70 wt. % to about 80 wt. % of $C_{12}$ AS and from 20 wt. % to about 30 wt. % of $C_{14}$ AS. A suitable example of such AS surfactant mixture according to the present invention is Texapon v95 by Cognis. Alternatively, the AS surfactant is the so-called coco-AS, which is derived from coconut oil and contains a mixture of AS surfactants, such as sodium caprylic sulfate, sodium capric sulfate, sodium lauryl sulfate, sodium myristyl sulfate, sodium oleic sulfate, sodium stearyl sulfate, and others.

In more concentrated formulations with 2×, 3×, or 4× compaction ratios, the AS surfactants may be present in higher amounts ranging from 15% to 40%, and preferably from 25% to 35%, by weight of the concentrated formulations.

Weight Ratio Between the BAS and the AS Surfactants

The weight ratio of the BAS surfactants to the AS surfactants is preferably in the range of from about 10:1 to about 1:5, more preferably from about 5:1 to about 1:3, and most preferably from 4:1 to 1:2.

Co-Surfactant (C): Linear Alkylbenzene Sulphonate ("LAS")

Another anionic surfactant that is suitable for use as a co-surfactant for the BAS surfactants in the detergent composition of the present invention (either alone or in addition to MCAS) is a linear alkylbenzene sulphonate (LAS), particularly a $C_{10}$-$C_{20}$ LAS.

LAS anionic surfactants are well known in the art and can be readily obtained by sulphonating commercially available linear alkylbenzenes. Exemplary $C_{10}$-$C_{20}$ linear alkylbenzene sulphonates that can be used in the present invention include alkali metal, alkaline earth metal or ammonium salts of $C_{10}$-$C_{20}$ linear alkylbenzene sulphonic acids, and preferably the sodium, potassium, magnesium and/or ammonium salts of $C_{12}$-$C_{18}$ or $C_{11}$-$C_{14}$ linear alkylbenzene sulphonic acids. More preferred are the sodium or potassium salts of $C_{12}$ linear alkylbenzene sulphonic acids, and most preferred is the sodium salt of $C_{12}$ linear alkylbenzene sulphonic acid, i.e., sodium dodecylbenzene sulphonate.

If present, the LAS surfactant may be present in the detergent composition of the present invention in an amount ranging from about 0.5% to about 30%, preferably from about 1% to about 20%, and more preferably from about 2% to about 15%, by total weight of the detergent composition. In a most preferred embodiment of the present invention, the detergent composition contains from about 2 wt. % to about 4 wt. % of a sodium, potassium, or magnesium salt of $C_{12}$ linear alkylbenzene sulphonic acid.

In more concentrated formulations with 2×, 3×, or 4× compaction ratios, the LAS surfactants may be present in higher amounts ranging from 15% to 40%, and preferably from 25% to 35%, by weight of the concentrated formulations.

Weight Ratio Between the BAS and the LAS Surfactants

The weight ratio of the BAS surfactants to the LAS surfactants is preferably in the range of from about 10:1 to about 1:5, more preferably from about 5:1 to about 1:3, and most preferably from 4:1 to 1:2.

Weight Ratio Between the AS and the LAS Surfactants

In a particularly preferred embodiment of the present invention, LAS is used in combination with AS as co-surfactants for BAS.

The weight ratio of AS to LAS is preferably in the range of 3:1 to 1:3, preferably from 2:1 to 1:2, and more preferably from 2:3 to 3:2. The detergent composition of the present invention with such an AS-to-LAS weight ratio exhibits superior wash suds, both in the Initial Wash Generation and the Suds Mileage.

Co-Surfactant (D): Fatty Acids or Salts Thereof

Another group of suitable co-surfactants for the BAS surfactants in the detergent composition of the present invention (either alone, or in combination with AS and/or LAS) include one or more fatty acids or salts thereof. It is particularly preferred to use the fatty acids or salts thereof in combination with the AS and LAS surfactants described hereinabove as co-surfactants for the BAS surfactant, to optimize the sudsing profile of the resulting detergent composition.

Suitable fatty acids or salts that can be used in the present invention include one or more $C_{10}$-$C_{22}$ fatty acids or alkali salts thereof. Such alkali salts include monovalent or divalent alkali metal salts like sodium, potassium, lithium and/or magnesium salts as well as the ammonium and/or alkylammonium salts of fatty acids, preferably the sodium salt. Preferred fatty acids or salts thereof for use herein contain from 10 to 20 carbon atoms, and more preferably 12 to 18 carbon atoms. Exemplary fatty acids/salts that can be used may be selected from caprylic acid, capric acid, lauric acid, myristic acid, myristoleic acid, palmitic acid, palmitoleic acid, sapienic acid, stearic acid, oleic acid, elaidic acid, vaccenic acid, linoleic acid, linoelaidic acid, α-linoelaidic acid, arachidic acid, arachidonic acid, eicosapentaenoic acid, behenic acid, erucic acid, and docosahexaenoic acid, and salts thereof. Saturated fatty acids/salts, such as caprylic acid, capric acid, lauric acid, myristic acid, palmitic acid, stearic acid, arachidic acid, behenic acid, and salts thereof, are preferred, but not necessary, for the practice of the present invention. Among these saturated fatty acids/salts, lauric acid, myristic acid, palmitic acid and salts thereof are particularly preferred.

If present, the fatty acids or salts can be present in the detergent compositions of the present invention at a relatively high level, i.e., from about 2 wt. % to about 6 wt. %, preferably from about 2.5 wt. % to about 4 wt. %, to help increase the wash suds volume and improve the sudsing performance. When the detergent composition is in a concentrated form, especially a concentrated powder or granular form, the fatty acids or salts thereof can be present at a significantly higher level, e.g., from about 4% to about 12%, and preferably from about 5% to about 8%, by total weight of the concentrated detergent composition.

In a particularly preferred embodiment of the present invention, the detergent composition contains from about 2.5 wt. % to about 4 wt. % of one or more fatty acids or salts selected from the group consisting of lauric acid, myristic acid, palmitic acid and salts thereof.

Additional Surfactants

In addition to the primary surfactants and co-surfactants described hereinabove, the detergent compositions of the present invention may also contain one or more additional surfactants, as long as such additional surfactants do not adversely affect the sudsing profile or otherwise interfere with functionalities of the above-described surfactants.

Such additional surfactants may be selected from other anionic surfactants (different from the BAS, AS, and LAS surfactants described hereinabove), other nonionic surfactants (different from the Short AA surfactants described hereinabove), cationic surfactants, zwitterionic surfactants, amphoteric surfactants, and mixtures thereof. Such additional surfactants may be present in the detergent composition of the present invention in a total amount ranging from about 1% to about 30% by total weight of the composition, preferably from about 2% to about 20%, more preferably from about 5% to about 15%.

Detergent Composition

As used herein the phrase "detergent composition" or "cleaning composition" or includes compositions and formulations designed for cleaning soiled material. Such compositions include but are not limited to, laundry detergent compositions and detergents (either with the typical surfactant activity or in a concentrated form with significantly higher surfactant activity), fabric softening compositions, fabric enhancing compositions, fabric freshening compositions, laundry prewash, laundry pretreat, laundry additives, spray products, dry cleaning agent or composition, laundry rinse additive, wash additive, post-rinse fabric treatment, ironing aid, dish washing compositions, hard surface cleaning compositions, unit dose formulation, delayed delivery formulation, detergent contained on or in a porous substrate or nonwoven sheet, and other suitable forms that may be apparent to one skilled in the art in view of the teachings herein. Such compositions may be used as a pre-laundering treatment, a post-laundering treatment, or may be added during the rinse or wash cycle of the laundering operation. The detergent compositions may have a form selected from liquid, powder, single-phase or multi-phase unit dose, pouch, tablet, gel, paste, bar, or flake.

Because the surfactant system itself provides the desired sudsing benefit, the detergent composition of the present invention does not require any suds suppressors, such as silicone antifoam or suds collapsing polymers, which functions to minimize the manufacturing and processing costs associated with such detergent composition. In a preferred embodiment of the present invention, the detergent composition is substantially free of, and preferably is essentially free of, silicone suds suppressor. In a more preferred embodiment of the present invention, the detergent composition is substantially free of, or essentially free of, any suds suppressor.

The detergent composition of the present invention can be formulated or designed either as an automatic machine wash detergent product, or a semi-automatic detergent product, or a hand-wash detergent product. Due to the improved sudsing profile of such composition, which is most visible to the consumers during hand-wash, it is preferred that it is a detergent product specifically designed for hand-wash, in order to highlight its sudsing benefit and delight the consumer.

Granular Detergent Compositions

Preferably, but not necessarily, the detergent composition of the present invention is a granular detergent composition, and more preferably a granular laundry detergent composition, having a density ranging from 250 g/1 to about 1000 g/1, more preferably from about 300 g/1 to about 900 g/1, and most preferably from about 400 g/1 to about 850 g/1.

Such a granular detergent composition may further comprise, in addition to the ingredients described hereinabove: (a) from about 0.1% to about 40%, preferably from about 0.5% to about 30%, and more preferably from about 3% to about 25%, of a water-soluble alkali metal carbonate, by total weight of such granular detergent composition; and/or (b) from about 10% to about 95%, preferably from about 20% to about 90%, and more preferably from about 30% to about 80%, of a water-soluble alkali metal sulfate, by totally weight of such granular detergent composition; and/or (c) from about 10% to about 95%, preferably from about 20% to about 90%, and more preferably from about 30% to about 80%, of a water-soluble alkali metal chloride, by totally weight of such granular detergent composition. Preferably, the water-soluble alkali metal carbonate is sodium carbonate; the water-soluble alkali metal sulfate is sodium sulfate; and the water-soluble alkali metal chloride is sodium chloride. Such a granule laundry detergent composition may further comprise one or more adjunct ingredients commonly used for formulating granular laundry detergent compositions, such as builders, carriers, structurants, flocculating aid, chelating agents, dye transfer inhibitors, enzymes, enzyme stabilizers, catalytic materials, bleach activators, hydrogen peroxide, sources of hydrogen peroxide, preformed peracids, polymeric dispersing agents, clay soil removal/anti-redeposition agents, brighteners, suds suppressors, dyes, perfumes, structure elasticizing agents, fabric softeners, hydrotropes, processing aids, pigments and/or aesthetic particles.

Preferably, the granular laundry detergent composition of the present invention comprises only low levels of phosphate and zeolite builders, and preferably it is substantially free of, or more preferably it is completely free of, phosphate and zeolite builders.

In a particularly preferred, but not necessary, embodiment of the present invention, a granular laundry detergent composition is provided, which contains: (1) from about 10 wt to about 30 wt. % of BAS; and (2) from 0 wt. % to 0.5 wt. % of AxS.

In another preferred but not necessary embodiment of the present invention, a granular laundry detergent composition contains: (1) from about 10 wt to about 15 wt. % of BAS; (2) from about 1 wt. % to about 5 wt. % of Short Chain AA; (3) from 0 wt. % to 0.5 wt. % of AxS; and (4) one or more additional ingredients. Unless otherwise specified, the one or more additional ingredients as used herein and in sections hereinafter typically are provided in an amount that makes up for 100% of the total weight of the respective composition.

In still another preferred but not necessary embodiment of the present invention, a granular laundry detergent composition contains: (1) from about 10 wt to about 15 wt. % of BAS; (2) from about 1 wt. % to about 5 wt. % of AS; (3) from 0 wt. % to 0.5 wt. % of AxS; and (4) one or more additional ingredients.

In yet another preferred but not necessary embodiment of the present invention, a granular laundry detergent composition contains: (1) from about 3 wt. % to about 8 wt. % of BAS; (2) from about 5 wt. % to about 15 wt. % of AS; (3) from 0 wt. % to 0.5 wt. % of AxS; and (4) one or more additional ingredients.

In a still further preferred but not necessary embodiment of the present invention, a granular laundry detergent composition contains: (1) from about 3 wt. % to about 8 wt. % of BAS; (2) from about 2 wt. % to about 6 wt. % of AS; (3) from about 2 wt. % to about 6 wt. % of LAS; (4) from about 1 wt. % to about 4 wt. % of fatty acids or salts thereof; (5) from 0 wt. % to 0.5 wt. % of AxS; and (6) one or more additional ingredients.

Liquid Laundry Detergent Compositions

The detergent composition may be a liquid detergent composition, preferably a liquid laundry detergent composition, having a viscosity ranging from about 200 to about 800 mPa·s measured at 25° C. at a shear rate of 20 $sec^{-1}$. The liquid detergent composition may be packaged in a single phase or multiphase unit dose form, i.e., it is contained in a single compartment or multi-compartment water-soluble pouch formed, for example, by a water-soluble polymer such as polyvinyl alcohol (PVA) and/or polyvinylpyrrolidone (PVP).

The liquid detergent composition of the present invention may further comprise, in addition to the ingredients described hereinabove, from about 0.1% to about 10%, preferably from about 0.5% to about 8%, and more preferably from about 1% to about 5% of one or more acids, such as citric acid, boric acid, and mixture thereof, by total weight of the liquid detergent composition. Preferably, the liquid detergent composition contains from about 1 wt. % to about 3 wt. % of citric acid and/or from about 1 wt. % to about 3 wt. % of boric acid. In addition, fatty acids, particularly $C_{12}$-$C_{18}$ fatty acids, or salts thereof can be included in the liquid laundry detergent composition of the present invention. The total amount of such fatty acids or salts may range from about 0.1 wt. % to about 5 wt. %, preferably from about 0.5 wt. % to about 4 wt. %, and more preferably from about 0.7 wt. % to about 3 wt. %.

The liquid detergent composition of the present invention typically contains one or more carriers, such as water. It can contain either water alone as the sole carrier, or mixtures of organic solvent(s) with water as carriers. Suitable organic solvents are linear or branched lower $C_1$-$C_8$ alcohols, diols, glycerols or glycols; lower amine solvents such as $C_1$-$C_4$ alkanolamines, and mixtures thereof. Particularly preferred organic solvents include 1,2-propanediol, ethanol, glycerol, monoethanolamine and triethanolamine. The carriers are typically present in the liquid detergent composition of the present invention at levels in the range of from about 10% to about 95%, preferably from about 25% to about 75%, by total weight of the liquid detergent composition. In some embodiments, water is from about 85 to about 100 wt. % of the carrier. In other embodiments, water is absent and the composition is anhydrous. Highly preferred compositions afforded by the present invention are clear, isotropic liquids.

The liquid detergent compositions of the invention may also contain one or more adjunct ingredients commonly used for formulating liquid laundry detergent compositions, such as builders, fillers, carriers, structurants or thickeners, clay soil removal/anti-redeposition agents, polymeric soil release agents, polymeric dispersing agents, polymeric grease cleaning agents, enzymes, enzyme stabilizing systems, amines, bleaching compounds, bleaching agents, bleach activators, bleach catalysts, brighteners, dyes, hueing agents, dye transfer inhibiting agents, chelating agents, softeners or conditioners (such as cationic polymers or silicones), perfumes (including perfume encapsulates), hygiene and malodor treatment agents, and the like.

In a particularly preferred, but not necessary, embodiment of the present invention, a liquid laundry detergent composition is provided, which contains: (1) from about 10 wt to about 30 wt. % of BAS; (2) from 0 wt. % to 0.5 wt. % of AxS; and (3) one or more additional ingredients.

In another preferred but not necessary embodiment of the present invention, a liquid laundry detergent composition contains: (1) from about 10 wt to about 15 wt. % of BAS; (2) from about 1 wt. % to about 5 wt. % of Short Chain AA; (3) from 0 wt. % to 0.5 wt. % of AxS; and (4) one or more additional ingredients.

In still another preferred but not necessary embodiment of the present invention, a liquid laundry detergent composition contains: (1) from about 10 wt to about 15 wt. % of BAS; (2) from about 1 wt. % to about 5 wt. % of AS; (3) from 0 wt. % to 0.5 wt. % of AxS; and (4) one or more additional ingredients.

Methods of Use

The present invention includes methods for treating soiled material using the detergent compositions of the present invention. As will be appreciated by one skilled in the art, the detergent compositions of the present invention are suited for use in laundry pretreatment applications, laundry cleaning applications, dish cleaning applications, and home care applications.

Preferably, such a method is a method of using the detergent compositions of the present invention to clean soiled material, which includes, but are not limited to, the steps of providing a detergent composition as described hereinabove (either in neat form or diluted in a wash liquor), contacting such detergent composition with at least a portion of a soiled material, and then rinsing the soiled material.

For use in laundry pretreatment applications, the method may include contacting the detergent compositions described herein with soiled fabric. Following pretreatment, the soiled fabric may be laundered in a washing machine or otherwise rinsed.

The detergent compositions of the present invention are particular suitable for hand washing applications, or combined hand washing with semi-automatic washing machines. Specifically, the consumers directly bring the soiled material into contact with the detergent compositions, manually or semi-manually clean the soiled material, and then rinse off the soiled material in one or more rinse cycles.

Alternatively, the detergent compositions of the present invention are suitable for machine laundry methods, which may comprise treating soiled laundry with an aqueous wash solution in a washing machine having dissolved or dispensed therein an effective amount of a machine laundry detergent composition in accord with the invention.

Another method includes contacting a nonwoven substrate impregnated with an embodiment of the detergent composition with soiled material. As used herein, "nonwoven substrate" can comprise any conventionally fashioned nonwoven sheet or web having suitable basis weight, caliper (thickness), absorbency, and strength characteristics. Non-limiting examples of suitable commercially available nonwoven substrates include those marketed under the tradenames SONTARA® by DuPont and POLYWEB® by James River Corp.

An "effective amount" of the detergent composition means from about 10 g to about 300 g of product dissolved or dispersed in a wash solution of volume from about 5 L to about 65 L. The water temperatures may range from about 5° C. to about 100° C. The water to soiled material (e.g., fabric) ratio may be from about 1:1 to about 30:1. The detergent compositions may be employed at concentrations of from about 500 ppm to about 15,000 ppm, preferably from about 1000 ppm to about 10,000 ppm and more preferably from about 3000 ppm to about 5000 ppm, in solution. In the context of a fabric laundry composition, usage levels may also vary depending not only on the type and severity of the soils and stains, but also on the wash water temperature, the volume of wash water, as well as the type of washing machine (e.g., top-loading, front-loading, top-loading, vertical-axis Japanese-type automatic washing machine).

The detergent compositions herein may be used for laundering of fabrics at reduced wash temperatures. These methods of laundering fabric comprise the steps of delivering a laundry detergent composition to water to form a wash liquor and adding a laundering fabric to said wash liquor, wherein the wash liquor has a temperature of from about 0° C. to about 20° C., or from about 0° C. to about 15° C., or from about 0° C. to about 9° C. The fabric may be contacted to the water prior to, or after, or simultaneous with, contacting the laundry detergent composition with water.

Test Methods

Various techniques are known in the art to determine the properties of the compositions of the present invention. However, the following assays must be used in order that the invention described and claimed herein may be fully understood.

Test 1: Sudsing Profile Test (for Determining Various Sudsing Parameters)

Sudsing profile of test detergent compositions herein is measured by employing a suds cylinder tester (SCT). The SCT has a set of eight (8) cylinders. Each cylinder is a plastic cylinder about 66 cm long that has uniform inner diameter of 50 mm through its length and can be capped or sealed by a rubber stopper during rotation. The 8 cylinders are all attached to a horizontal axis at the middle part of each cylinder. All 8 cylinders are arranged perpendicular to the horizontal axis but parallel to one another. The cylinders are spaced apart with equal distances in between, and they may be rotated together the around the horizontal axis along a vertical plan that is perpendicular to the horizontal axis at a speed of 20-22 revolutions per minute (rpm).

The following factors may affect the measurement results and therefore should be controlled carefully: (a) concentration of the test detergent composition in the washing solution and rinsing solution; (b) hardness of the water used to form the washing and rinsing solution; (c) water temperature; (d) speed and number of rotations of the SCT cylinders; (e) type of soil used and the total soil load used in the wash; and (f) cleanness of the interior of the SCT cylinders.

Following steps are followed to obtain the suds measurements for each test detergent composition:

1. Weigh 1.5 grams of the test detergent composition (either in granular or liquid form) and dissolve it in 300 ml of reverse-osmosis (RO) water with a water hardness level of about 16 gpg (Ca/Mg 4:1 formed by mixing 21.9 mg/L $CaCl_2.2H_2O$ and 111.3 mg/L $MgCl_2.6H_2O$) at room temperature;
2. Stir the mixture for at least 15 minutes to form a sample wash solution containing the test detergent composition at 5000 ppm;
3. Pour the sample solution into to a SCT cylinder, close it tightly with a rubber stopper and lock the cylinder in place ready for rotation. Other SCT cylinders can be filled with sample solutions formed by using other test detergent compositions for simultaneous suds measurement of different test detergent compositions;
4. Turn on the SCT to rotate the cylinders for 10 revolutions at a speed of 22 rpm;
5. Stop the SCT rotation and lock the SCT cylinders in an upright position;
6. Wait for 1 minute before recording the suds volume (represented by the absolute suds height) in each SCT cylinder, which is deemed the suds volume generated by the test detergent composition at 10 revolutions. Because all SCT cylinders have the same interior diameter, the suds volume at any given point can therefore be simply represented by the absolute height of the suds in centimeters (cm) inside each SCT cylinder, which is measured by subtracting the height of the wash or rinse solution from the total height of the suds plus the wash or rinse solution.
7. Turn on the SCT to continue rotation of the cylinders for additional 20 revolutions at a speed of 22 rpm, stop the SCT and record suds volume as that at 30 revolutions;
8. Repeat Step 7 to record suds volume at 50 and 70 revolutions at a speed of 22 rpm;
9. Stop the SCT rotation, remove the rubber stoppers from the cylinders, and place 1 piece of fabric loaded with Beijing clay (BJ Clay) and 1 piece of fabric loaded with dirty cooking oil (DCO), the preparation of which is described hereinbelow, into each SCT cylinder.

Preparation of Fabric Loaded with BJ Clay:

Disperse 20 g of BJ Clay (collected from 15 cm below the earth surface in Beijing, China and then dried at the room temperature for 1-2 weeks, followed by blending in a heavy duty blender and meshing through 150-200# sieves) into 80 ml of deionized water via agitation to make a clay suspension. Alternatively, Arizona clay (i.e., Arizona Test Dust with a median particle size of about 0.889 micron and a mean particle size of about 0.942 micron from Powder Technology Inc. in the United States) can be used in place of BJ Clay;

Keep agitating the clay suspension, while brushing 2 g of such clay suspension onto the center of a 10 cm×10 cm piece of CW98 white cotton knit (100%) fabric supplied by DaXinFangZHi (Beijing, China) to form a round shape stain with a diameter of about 5 cm; and The cotton fabric is then left to dry at room temperature before used.

Preparation of Fabric Loaded with DCO:

Use 100 g of peanut oil to fry 20 g of salty fish for 2 hours at 150-180° C. to form DCO.

Pipette 0.6 ml of the DCO onto the center of the 10 cm×10 cm cotton fabric described hereinabove to form a round shape stain with a diameter of about 5 cm.

Cut the cotton fabric into 2 equal pieces and use 1 piece for each performance evaluation.

10. Place the rubber stoppers back onto the SCT cylinders.
11. Turn on the SCT to continue rotation of the cylinders for additional 40 revolutions at a speed of 22 rpm, stop the SCT and record suds volume as that of 110 revolutions.
12. Repeat Steps 9-11, and record the suds volume as that of 150 revolutions. Note that further addition of soiled fabrics into the wash solutions in the SCT cylinders is to mimic real washing conditions where more soil is gradually dissolved into the washing solution from the fabrics as the washing cycle continues. Therefore, this test is relevant for determining the initial suds generation by a test detergent composition, as well as the suds mileage sustained through the washing cycle while more soil is gradually dissolved into the washing solution.

13. Pour 37.5 ml of the sample wash solution (without any of the treated fabric pieces) gently out of the SCT cylinder into a 300 ml beaker. Add 262.5 ml of RO water with a water hardness level of 16 gpg (Ca/Mg 4:1) into the beaker to form a diluted solution with a total volume of 300 ml (referred to as the "Rinse Solution"). Dispose of the remaining test solution and all the stained fabric swatches from the SCT cylinder and clean the SCT cylinder with tap water. Pour the 300 ml Rinse Solution from the beaker back into the cleaned SCT cylinder. Repeat these steps for each of the test solutions contained in each of the remaining SCT cylinders.
14. Turn on the SCT to continue rotation of the cylinders for additional 20 revolutions at a speed of 22 rpm and stop the SCT. Take a picture right after the SCT is stopped and read the suds height from the picture (this is done to ensure data accuracy due to the very rapid collapsing of suds in the inventive samples), which is recorded as the suds volume at 0 minute after 170 revolutions. This suds data is taken after the wash solution is replaced by the Rinse Solution, and is therefore recorded as the "Rinse Suds at 0 Minute."
15. Another reading of the suds volume in the SCT cylinders is taken 1 minute after the SCT is stopped at 170 revolutions (which is referred to as the "Rinse Suds at 1 Minute").
16. The suds reduction rate from 0 minute to 1 minute during the first rinse with the Rinse Solution is calculated as follows:

$$\text{Rinse Suds Reduction Rate (\%/min)} = \left(\frac{\text{Rinse Suds at 0 Min} - \text{Rinse Suds at 1 Min}}{\text{Rinse Suds at 0 Min}}\right) \times \frac{100}{1\ \text{Min}}$$

17. Following are the sudsing data recorded by this test method:

| | | |
|---|---|---|
| Initial Wash Suds Volume (cm) | Average of the suds volume (measured by height) data recorded at 10, 30, 50 and 70 revolutions (representing the W-1 stage) | Washing Cycle: Wash data analysis is focused on "Flash Suds" generation during the W-1 stage and "Suds Mileage" through the wash during the W-2 stage. |
| Suds Mileage (cm) | Average of the suds volume (measured by height) data recorded at 110 and 150 revolutions (representing the W-2 stage) | |
| Wash Suds Retention Percentage (%) | $= \frac{\text{Suds Mileage}}{\text{Initial Wash Suds Volume}} \times 100$ | |
| 1/8 Rinse Suds at 0 Minute (cm) | Suds volume (measured by height) data recorded at 0 minute after 170 revolutions (representing the R-1 stage) | Rinsing Cycle: Rinse data analysis of focused on "Initial Rinse Suds" measured during the R-1 stage, and "End Rinse Suds" measured at the R-2 stage. The Rinse Suds Reduction Rate derives from and therefore jointly evaluates the two data points. |
| 1/8 Rinse Suds at 1 Minute (cm) | Suds volume (measured by height) data recorded at 1 minute after 170 revolutions (representing the R-2 stage) | |
| Rinse Suds Reduction Rate (%/min) | Suds reduction rate from 0 minute to 1 minute during the first rinse (1/8 Rinse). | |

Test 2: Surface Tension Test (for Determining the First Order Surface Tension and the Second Order Surface Tension)

Surface tension (including the First Order Surface Tension and the Second Order Surface Tension) is measured using a Kruss K100 (BTC-919) force tensiometer from Kruss GmbH (Hamburg, Germany). Kruss K100 force tensiometer measures equilibrium surface tension by using the Wilhelmy plate method. The measurements are conducted at ambient temperature in the SFT-Plate mode, with: (1) a detection speed of 6 mm/rain; (2) a detection sensitivity of 0.01 g; (3) an immersion depth of 2.00 mm. Surface tension is reported as a function of time.

For each test detergent sample, the following steps are taken to measure the surface tension at different total detergent concentrations:

1. Weight 5.0000 g (±0.0005 g) of a test detergent sample and place it into a 200 ml glass beak;
2. Add 150 ml of deionized (DI) water into the 200 ml glass beaker and stir continuously for 15 minutes to form a clear sample solution.
3. Pour the sample solution from the 200 ml glass beaker into a 1 L flask, followed by rinsing the 200 ml beaker with a sufficient amount of DI water and then pouring the rinse water into the 1 L flask so as to fill ⅔ volume of the 1 L flask. Continue stirring the sample solution for 5 minutes.
4. Pipe 10 ml of a 16 gpg (Ca: Mg ratio=4:1) hardness water into the 1 L flask and fill the entire volume of the 1 L flask with DI water. Continue to stir for 5 minutes, thereby forming a sample solution having a total detergent concentration of 5000 ppm, which mimics a washing solution typically used during the washing cycle of a fabric laundering process.
5. Inject 60 ml of the 5000 ppm sample solution from the 1 L flask into a test beaker of the Kruss K100 force tensiometer to measure the surface tension of the sample solution.
6. Conduct three (3) replicate measurements of Step 5 for each sample solution, and the average value of these measurements is recorded as the First Order Surface Tension of the test detergent sample (i.e., at the total detergent concentration of 5000 ppm).
7. Weigh another 20 g (±0.0002 g) of the 5000 ppm sample solution from the 1 L flask and mix it with 280 g (±0.0028 g) of the 16 gpg (Ca: Mg ratio=4:1)

hardness water. Continue to stir for 5 minutes, thereby forming a diluted sample solution having a total detergent concentration of 333.33 ppm, which mimics a rinse solution typically used during the rinse cycle of a fabric laundering process.

8. Inject 60 ml of the 333.33 ppm diluted sample solution from the 1 L flask into a test beaker of the Kruss K100 force tensiometer, and measure surface tension of the diluted sample solution.
9. Conduct three (3) replicate measurements of Step 8 for each diluted sample solution. The average value of these measurements is recorded as the Second Order Surface Tension of the test detergent sample (i.e., at the total detergent concentration of 333.33 ppm).
10. Difference between the First Order Surface Tension and Second Order Surface Tension ("ΔST") is calculated as follows:

ΔST=Second Order Surface Tension−First Order Surface Tension.

EXAMPLES

Example 1: Granular Laundry Detergent Formulations

The following eight (8) inventive granular laundry detergent formulations A-G are prepared according to the present invention.

TABLE 1

| Ingredients* (wt %) | A | B | C | D | E | F | G | H |
|---|---|---|---|---|---|---|---|---|
| BAS[1] | 12 | 12 | 15 | 15 | 12 | 12 | 5 | 5 |
| $AE_{1.8}S$ | — | 0.2 | — | 0.2 | — | — | — | — |
| Short chain AA[2] | — | — | — | — | 3 | — | — | — |
| MCAS[3] | — | — | — | — | — | 3 | 10 | 4.4 |
| LAS[4] | — | — | — | — | — | — | — | 3.1 |
| Sodium salts of fatty acids (soap)[5] | — | — | — | — | — | — | — | 2.5 |
| Carboxymethyl Cellulose | 0.19 | 0.19 | 0.19 | 0.19 | 0.19 | 0.19 | 0.19 | 0.19 |
| Acrylic acid/maleic acid copolymer | 1.84 | 1.84 | 1.84 | 1.84 | 1.84 | 1.84 | 1.84 | 1.84 |
| Polyethylene glycol-Polyvinyl acetate graft polymer | 0.29 | 0.29 | 0.29 | 0.29 | 0.29 | 0.29 | 0.29 | 0.29 |
| Silicate (2.35R) | 2.83 | 2.83 | 2.83 | 2.83 | 2.83 | 2.83 | 2.83 | 2.83 |
| Sodium carbonate | 17.28 | 17.28 | 17.28 | 17.28 | 17.29 | 17.28 | 17.28 | 17.28 |
| Sodium sulfate | Q.S. | Q.S. | Q.S. | Q.S. | Q.S. | Q.S. | Q.S. | Q.S. |
| Total | 100 | 100 | 100 | 100 | 100 | 100 | 100 | 100 |

*Note that all ingredient concentrations in this example and all other examples are the concentrations of the pure materials in the final composition, not the concentrations of the raw materials added, unless otherwise specified.

[1]Isalchem ® 123, which is a mixture of branched, unalkoxylated $C_{12}$-$C_{13}$ alkyl sulfates commercially available from Sasol. It contains more than 40% of $C_{12}$ AS and more than 40% of $C_{13}$ AS, both branched and unalkoxylated and having at least 90% branching. It is provided as a 75% active raw material with 0.6% of NaOH, 0.8% of sodium sulfate, 1-1.3% $C_{12}$-$C_{13}$ residue alcohol carried over from the synthesis of the alkyl sulfate, and balance water.

[2]Emulan ® HE50, which is a linear $C_6$ alkyl ethoxylated alcohol with 5 EO commercially available from BASF. It is provided as a 100% active raw material.

[3]A mixture of linear, unalkoxylated alkyl sulfates containing about 71% of $C_{12}$ AS, about 23% of C14 AS, about 5% of C16 AS, and less than about 1% of AS with alkyl chain length that is either no more than 10 or no less than 18.

[4]Sodium dodecylbenzene sulphonate.

[5]A mixture containing 87.4 wt % of sodium palmate, 4.6 wt % of sodium palm kernelate, 0.3 wt % of sodium hydroxide, 0.4 wt % of sodium chloride, 0.3 wt % of glycerol, and balance water.

The sudsing profiles of the above-listed 8 inventive granular laundry detergent formulations A-H are measured by using the method described in Test 1. The surface tension profiles of the first four (4) inventive granular laundry detergent formulations A-D are measured by using the method described in Test 2. The measurement results are tabulated as follows:

TABLE 2

| | A | B | C | D | E | F | G | H |
|---|---|---|---|---|---|---|---|---|
| Sudsing Profile | | | | | | | | |
| Initial Wash Suds Volume (cm) | 44.5 | 44.8 | 45.3 | 43.8 | 34.7 | 41.5 | 39.1 | 32.3 |
| Suds Mileage (cm) | 37.1 | 39.5 | 41.8 | 41.8 | 41.1 | 38.4 | 32.4 | 30.9 |
| Wash Suds Retention Percentage (%) | 83% | 88% | 92% | 95% | 118% | 93% | 83% | 96% |
| ⅛ Rinse Suds at 0 Min (cm) | 1.1 | 2 | 1.5 | 2.5 | 3.6 | 1.5 | 1.5 | 1 |
| ⅛ Rinse Suds at 1 Min (cm) | 0 | 0.7 | 0 | 0.7 | 0.7 | 0 | 0.7 | 0 |
| Rinse Suds Reduction Rate (%/min) | 100% | 65% | 100% | 72% | 81% | 100% | 53% | 100% |
| Surface Tension Profile** | | | | | | | | |
| $1^{st}$ Order Surface Tension (mN/m) | 26.41 | 26.58 | 26.79 | 27.14 | — | — | — | — |
| $2^{nd}$ Order Surface Tension (mN/m) | 42.22 | 38.86 | 40.85 | 39.37 | — | — | — | — |
| ΔST | 15.81 | 12.28 | 14.06 | 12.23 | — | — | — | — |

**The surface tension profiles of Formulations E-H are not measured, but it is expected that they also fall within the scope of the present invention.

The sudsing profiles of the above-listed 8 inventive granular laundry detergent formulations A-H all fall within the scope of the present invention, despite their compositional differences. Further, the surface tension profiles of the first 4 inventive granular laundry detergent formulations A-D also fall within the scope of the present invention.

Example 2: Liquid Laundry Detergent Formulations

The following five (5) inventive liquid laundry detergent formulations I-V are prepared according to the present invention.

TABLE 3

| Ingredients (wt %) | I | II | III | IV | V |
|---|---|---|---|---|---|
| BAS[1] | 12 | 12 | 15 | 15 | 12 |
| $AE_{1.8}S$ | — | 0.2 | — | 0.2 | — |
| MCAS[2] | — | — | — | — | 3 |
| Citric acid | 2 | 2 | 2 | 2 | 2 |
| Chelant (DTPA) | 0.19 | 0.19 | 0.19 | 0.19 | 0.19 |
| 1,2-propanediol | 1.21 | 1.21 | 1.21 | 1.21 | 1.21 |
| Boric acid | 2.1 | 2.1 | 2.1 | 2.1 | 2.1 |
| Polyethyleneimine[3] | 0.46 | 0.46 | 0.46 | 0.46 | 0.46 |
| NaOH | Sufficient to adjust pH to 7.5-8.0 | | | | |
| Water | Q.S. | Q.S. | Q.S. | Q.S. | Q.S. |
| Total | 100 | 100 | 100 | 100 | 100 |

[1]Isalchem ® 123, which is a mixture of branched, unalkoxylated $C_{12}$-$C_{13}$ alkyl sulfates commercially available from Sasol. It contains more than 40% of $C_{12}$ AS and more than 40% of $C_{13}$ AS, both branched and unalkoxylated and having at least 90% branching. It is provided as a 75% active raw material with 0.6% of NaOH, 0.8% of sodium sulfate, 1-1.3% $C_{12}$-$C_{13}$ residue alcohol carried over from the synthesis of the alkyl sulfate, and balance water.
[2]A mixture of linear, unalkoxylated alkyl sulfates containing about 71% of $C_{12}$ AS, about 23% of C14 AS, about 5% of C16 AS, and less than about 1% of AS with alkyl chain length that is either no more than 10 or no less than 18.
[3]$PEI_{600}EO_{20}$ having a polyethyleneimine core characterized by a molecular weight of about 600 with EO groups attached thereto, wherein the EO groups have an average degree of ethoxylation of about 20.

The sudsing profiles of the above-listed 5 inventive granular laundry detergent formulations I-V are measured by using the method described in Test 1. The surface tension profiles of the first four (4) inventive granular laundry detergent formulations I-IV are measured by using the method described in Test 2. The measurement results are tabulated as follows:

TABLE 4

| | I | II | III | IV | V |
|---|---|---|---|---|---|
| Sudsing Profile | | | | | |
| Initial Wash Suds Volume (cm) | 34.7 | 39.4 | 41.2 | 41.3 | 43.9 |
| Suds Mileage (cm) | 34.3 | 39.3 | 37.8 | 38.1 | 41.5 |
| Wash Suds Retention Percentage (%) | 98.8% | 99.7% | 91.7% | 92.3% | 94.5% |
| ⅛ Rinse Suds at 0 Min (cm) | 4 | 5.8 | 3.5 | 3.8 | 4.8 |
| ⅛ Rinse Suds at 1 Min (cm) | 0.7 | 2.1 | 0.9 | 1.3 | 1.8 |
| Rinse Suds Reduction Rate (%/min) | 82.5% | 63.8% | 74.3% | 65.8% | 62.5% |
| Surface Tension Profile*** | | | | | |
| 1st Order Surface Tension (mN/m) | 26.33 | 26.35 | 26.29 | 26.25 | — |
| 2nd Order Surface Tension (mN/m) | 41.18 | 38.98 | 41.02 | 39.77 | — |
| ΔST | 14.85 | 12.63 | 14.73 | 13.52 | — |

***The surface tension profile of Formulation V is not measured, but it is expected that it also falls within the scope of the present invention.

The sudsing profiles of the above-listed 5 inventive liquid laundry detergent formulations I-V all fall within the scope of the present invention, despite their compositional differences. Further, the surface tension profiles of the first 4 inventive liquid laundry detergent formulations I-IV also fall within the scope of the present invention.

Example 3: Sudsing Performance and Surface Tension Profile of Inventive Granular Laundry Detergent Compositions in Comparison with in-Market Granular Laundry Detergent Compositions Four (4) in-market granular laundry detergent products claiming an easy rinse benefit are obtained as comparative examples of granular laundry detergents, which include: (1) Diao Pai® laundry detergent powder for cold water laundering ("Diao Pai Powder"), commercially available from Nice Group Co., Ltd. (China); (2) the Attack® Detergent Plus Softener laundry detergent powder ("Attack Powder"), commercially available from Kao Corporation (Japan); (3) Liby® Easy Rinse laundry detergent powder ("Liby Powder"), commercially available from Guangzhou Liby Enterprise Group Co., Ltd. (China); and (4) the Omo® Blue laundry detergent powder ("Omo Powder"), commercially available from Unilever (Netherlands).

Also prepared are two (2) inventive examples I and J of granular laundry detergents with the following compositions, according to the present invention:

TABLE 5

| Ingredients* (wt %) | I | J |
|---|---|---|
| BAS[1] | 12 | 15 |
| Carboxymethyl Cellulose | 0.19 | 0.19 |
| Acrylic acid/maleic acid copolymer | 1.84 | 1.84 |
| Polyethylene glycol-Polyvinyl acetate graft polymer | 0.29 | 0.29 |
| Silicate (2.35R) | 2.83 | 2.83 |
| Sodium carbonate | 17.29 | 17.29 |
| Sodium sulfate | Q.S. | Q.S. |
| Total | 100 | 100 |

[1]Isalchem ® 123, which is a mixture of branched, unalkoxylated $C_{12}$-$C_{13}$ alkyl sulfates commercially available from Sasol. It contains more than 40% of $C_{12}$ AS and more than 40% of $C_{13}$ AS, both branched and unalkoxylated and having at least 90% branching. It is provided as a 75% active raw material with 0.6% of NaOH, 0.8% of sodium sulfate, 1-1.3% $C_{12}$-$C_{13}$ residue alcohol carried over from the synthesis of the alkyl sulfate, and balance water.

The sudsing profiles of the above-listed six (6) granular laundry detergents are measured by using the method described in Test 1. The surface tension profiles of these six (6) granular laundry detergents are measured by using the method described in Test 2. The measurement results are tabulated as follows:

| | Comparative Examples | | | | Inventive Eg. | |
|---|---|---|---|---|---|---|
| | Diao Pai Powder | Attack Powder | Liby Powder | Omo Powder | I | J |
| Sudsing Profile | | | | | | |
| Initial Wash Suds Volume (cm) | 41.3 | 43.4 | 44.3 | 44.6 | 43.2 | 44.5 |
| Suds Mileage (cm) | 36.6 | 37.5 | 40.8 | 44.9 | 37.5 | 40.9 |
| Wash Suds Retention Percentage (%) | 89% | 86% | 92% | 101% | 87% | 92% |
| ⅛ Rinse Suds at 0 Min (cm) | 6.6 | 4.5 | 5.4 | 4.4 | 1.5 | 2.8 |
| ⅛ Rinse Suds at 1 Min (cm) | 6.1 | 4.2 | 5.3 | 4.1 | 0 | 0 |
| Rinse Suds Reduction Rate (%/min) | 7.6% | 6.6% | 1.9% | 6.8% | 100% | 100% |
| Surface Tension Profile | | | | | | |
| $1^{st}$ Order Surface Tension (mN/m) | 29.33 | 30.06 | 28.64 | 27.71 | 26.74 | 26.81 |
| $2^{nd}$ Order Surface Tension (mN/m) | 32.93 | 29.56 | 33.37 | 28.19 | 43.58 | 42.64 |
| ΔST | 3.6 | −0.5 | 4.73 | 0.48 | 16.84 | 15.83 |

Each of the above-described sudsing parameters is calculated by averaging measurements from 3 replicates for each sample detergent composition.

The data shows that the four (4) in-market granular laundry detergent products all have sudsing profiles and surface tension profiles that fall outside of the scope of the present invention.

Specifically, the in-market granular laundry detergent products have too low a Rinse Suds Reduction Rate, i.e., significantly less than 40%/min. In fact, none of the in-market granular laundry detergent products exhibit a Rinse Suds Reduction Rate higher than 10%/min, i.e., very little suds reduction is observed during the first minute of the rinse cycle. In contrast, the inventive granular laundry detergent products exhibit 100%/min Rinse Suds Reduction Rate, i.e., all suds in the rinse solution disappear within one (1) minute from the start of the rinse cycle, resulting in a "zero suds" rinse solution.

Further, these in-market products have too small a difference between their First Order Surface Tension and Second Order Surface Tension, i.e., ΔST being significantly less than 12 mN/m.

Example 4: Sudsing Performance and Surface Tension Profile of Inventive Liquid Laundry Detergent Compositions in Comparison with in-Market Liquid Laundry Detergent Compositions Five (5) in-market liquid laundry detergent products claiming an easy rinse benefit are obtained as comparative examples of liquid laundry detergents, which include: (1) Blue Moon® Hand Wash Only liquid laundry detergent ("Blue Moon Liquid"), commercially available from Guangzhou Blue Moon Industry Co. Ltd. (China); (2) the Attack® Instant Clear Liquid laundry detergent ("Attack Liquid"), commercially available from Kao Corporation (Japan); (3) Diao Pai® Deep Clean liquid laundry detergent ("Diao Pai Liquid"), commercially available from Nice Group Co., Ltd. (China); (4) Chao Neng® Double Ion Stain Removal liquid laundry detergent ("Chao Neng Liquid"), commercially available from Nice Group Co., Ltd. (China); and (4) the Omo® Blue liquid laundry detergent ("Omo Liquid"), commercially available from Unilever (Netherlands).

Also prepared are two (2) inventive examples of liquid laundry detergents according to the present invention, which have the same compositional makeup as Formulations I and III in Example 2.

The sudsing profiles of the above-listed seven (7) liquid laundry detergents are measured by using the method described in Test 1. The surface tension profiles of these seven (7) liquid laundry detergents are measured by using the method described in Test 2. The measurement results are tabulated as follows:

| | Comparative Examples | | | | | Inventive Eg. | |
|---|---|---|---|---|---|---|---|
| | Blue Moon Liquid | Attack Liquid | Diao Pai Liquid | Chao Neng Liquid | Omo Liquid | I | III |
| Sudsing Profile | | | | | | | |
| Initial Wash Suds Volume (cm) | 35.2 | 33.5 | 30.1 | 29.4 | 36.1 | 37.3 | 39.6 |
| Suds Mileage (cm) | 38.4 | 32 | 27.4 | 27.1 | 26.3 | 34.3 | 37.6 |
| Wash Suds Retention Percentage (%) | 109% | 96% | 91% | 92% | 73% | 92% | 95% |
| ⅛ Rinse Suds at 0 Min (cm) | 9.3 | 9.8 | 7.7 | 8.9 | 7.7 | 2.2 | 3.8 |
| ⅛ Rinse Suds at 1 Min (cm) | 9.3 | 9.5 | 7.7 | 8.9 | 7.7 | 0.4 | 0.8 |
| Rinse Suds Reduction Rate (%/min) | 0% | 3.1% | 0% | 0% | 0% | 82% | 79% |
| Surface Tension Profile | | | | | | | |
| $1^{st}$ Order Surface Tension (mN/m) | 26.91 | 27 | 27.67 | 27.39 | 27.9 | 26 | 26.09 |
| $2^{nd}$ Order Surface Tension (mN/m) | 26.96 | 27.81 | 28.07 | 27.94 | 28.33 | 44.04 | 42.69 |
| ΔST | 0.05 | 0.81 | 0.4 | 0.55 | 0.43 | 18.04 | 16.6 |

Each of the above-described sudsing parameters is calculated by averaging measurements from 3 replicates for each sample detergent composition.

The data shows that the five (5) in-market liquid laundry detergent products all have sudsing profiles and surface tension profiles that fall outside of the scope of the present invention.

Specifically, the in-market liquid laundry detergent products have too low a Rinse Suds Reduction Rate, i.e., significantly less than 40%/min. In fact, none of the in-market liquid laundry detergent products exhibit a Rinse Suds Reduction Rate higher than 5%/min, and most actually exhibit a Rinse Suds Reduction Rate of 0%/min, i.e., no suds reduction is observed during the first minute of the rinse cycle. In contrast, the inventive liquid laundry detergent products exhibit a Rinse Suds Reduction Rate of 80%/min or more, i.e., a vast majority of the rinse suds disappear within one (1) minute from the start of the rinse cycle, resulting in a substantially clear rinse solution.

Further, these in-market products have too small a difference between their First Order Surface Tension and Second Order Surface Tension, i.e., ΔST being significantly less than 12 mN/m.

All percentages and ratios are calculated by weight unless otherwise indicated. All percentages and ratios are calculated based on the total composition unless otherwise indicated. It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A detergent composition comprising one or more surfactants, wherein said detergent composition is characterized by a sudsing profile defined by:

a) an Initial Wash Suds Volume of from 45 cm to 47 cm, wherein said Initial Wash Suds Volume is the suds volume by height measured during a first stage of a wash cycle in a laundering process; and b) a Suds Mileage of from 40 cm to 45 cm, wherein said Suds Mileage is the suds volume by height measured during a second, subsequent stage of the wash cycle in the laundering process; and c) a Rinse Suds Reduction Rate of from 100%/min to 110%/min, wherein said Rinse Suds Reduction Rate is the rate of suds volume reduction from a first stage of a rinse cycle in the laundering process to a second, subsequent stage of the rinse cycle in the laundering process, wherein the Initial Wash Suds Volume, the Suds Mileage, and the Rinse Suds Reduction Rate are measured according to the Suds Profile Test described herein, wherein said detergent composition is further characterized by:

(1) a First Order Surface Tension, which is measured in a first aqueous solution of said detergent composition having a first total detergent concentration of 5000 ppm; and (2) a Second Order Surface Tension, which is measured in a second aqueous solution of said detergent composition having a second total detergent concentration of 333 ppm, wherein the difference between the First Order Surface Tension and the Second Order Surface Tension is no less than 15 mN/, wherein the First Order Surface Tension ranges from 20 mN/m to 28 mN/m, wherein the Second Order Surface Tension ranges from 42 mN/m to 72 mN/m, wherein the Rinse Suds Reduction Rate is 100%/min, wherein said detergent composition is free of linear or branched alkoxylated alkyl sulfate surfactants, wherein said detergent composition is a granular detergent composition that further comprises: (a) from 3% to 25%, of a water-soluble alkali metal carbonate, by total weight of said granular detergent composition; (b) from 30% to 80%, of a water-soluble alkali metal sulfate, by total weight of said granular detergent composition; and (c) from 30% to 80%, of a water-soluble alkali metal chloride, by total weight of said granular detergent composition, wherein said one or more surfactants consist of a branched, unalkoxylated $C_6$-$C_{14}$ alkyl sulfate present in an amount ranging from 5% to 30%, by weight of the detergent composition and a linear or branched $C_4$-$C_{11}$ alkyl or aryl alkoxylated alcohol having a weight average degree of alkoxylation ranging from 1 to 10, and present in an amount ranging from 0.5% to 5%, by weight of the detergent composition.

2. A method of treating a soiled material, comprising the steps of:

a) providing a detergent composition according to claim 1;

b) contacting the detergent composition with at least a portion of the soiled material; and c) rinsing the soiled material.

3. The method of claim 2, wherein steps (b) and (c) are both conducted by hand, and wherein the soiled material is soiled fabric.

* * * * *